US008272367B2

(12) United States Patent
Shikama et al.

(10) Patent No.: US 8,272,367 B2
(45) Date of Patent: Sep. 25, 2012

(54) CONTROL SYSTEM FOR INTERNAL COMBUSTION ENGINE

(75) Inventors: Mahito Shikama, Wako (JP); Ryuji Kohno, Wako (JP); Eisei Yamazaki, Wako (JP); Hidekazu Hironobu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 561 days.

(21) Appl. No.: 12/527,063

(22) PCT Filed: Apr. 30, 2008

(86) PCT No.: PCT/JP2008/058237

§ 371 (c)(1),
(2), (4) Date: Aug. 13, 2009

(87) PCT Pub. No.: WO2008/152867

PCT Pub. Date: Dec. 18, 2008

(65) Prior Publication Data

US 2010/0116247 A1 May 13, 2010

(30) Foreign Application Priority Data

May 18, 2007 (JP) ..... 2007-132315

(51) Int. Cl.
*F02D 41/10* (2006.01)
*F02P 5/15* (2006.01)

(52) U.S. Cl. ..... 123/436; 123/406.24; 123/406.25; 123/406.5; 123/406.51; 123/492; 123/493; 123/675

(58) Field of Classification Search ..... 123/406.24, 123/406.25, 406.5, 406.51, 436, 492, 493, 123/675

See application file for complete search history.

(56) References Cited

U.S. PATENT DOCUMENTS

| | | | | |
|---|---|---|---|---|
| 4,919,098 | A * | 4/1990 | Shimada et al. | 123/406.46 |
| 5,097,809 | A * | 3/1992 | Sekozawa et al. | 123/406.19 |
| 5,452,698 | A * | 9/1995 | Denz et al. | 123/406.24 |
| 5,537,967 | A * | 7/1996 | Tashiro et al. | 123/192.1 |
| 6,039,028 | A * | 3/2000 | Stuntz et al. | 123/436 |
| 6,199,536 | B1 * | 3/2001 | Flinspach et al. | 123/399 |
| 6,718,943 | B1 * | 4/2004 | De La Salle et al. | 123/406.24 |
| 6,853,158 | B2 * | 2/2005 | Tan et al. | 318/135 |
| 6,955,155 | B2 * | 10/2005 | Surnilla | 123/339.11 |
| 7,069,903 | B2 * | 7/2006 | Surnilla et al. | 123/339.19 |
| 7,317,983 | B2 * | 1/2008 | Ishizuka et al. | 701/103 |
| 2004/0230367 | A1 * | 11/2004 | Miller et al. | 701/111 |

(Continued)

FOREIGN PATENT DOCUMENTS

DE 19806393 A1 8/1999

(Continued)

*Primary Examiner* — Erick Solis
(74) *Attorney, Agent, or Firm* — Squire Sanders (US) LLP

(57) ABSTRACT

A control system for an internal combustion engine for driving a vehicle, which controls an output torque of the engine, is provided. In this control system, a rapid change in a demand torque of the engine is detected, and a feedforward correction amount is generated during a correction period which is substantially equal to a resonance period of a powertrain of the vehicle, from a time when the rapid change in the demand torque is detected. An output torque control amount of the engine is corrected with the feedforward correction amount. A torque change amount integrated value is calculated by integrating an amount of change in the demand torque, and the feedforward correction amount is generated according to the torque change amount integrated value.

26 Claims, 13 Drawing Sheets

U.S. PATENT DOCUMENTS

2006/0293828 A1 12/2006 Ishizuka et al.

FOREIGN PATENT DOCUMENTS

JP 01-121570 5/1989
JP 08-232696 A 9/1996
JP 09-014116 A 1/1997
JP 11-091411 A 4/1999
JP 2000-205008 7/2000
JP 2007-032540 A 2/2007

* cited by examiner

[FIG. 1]
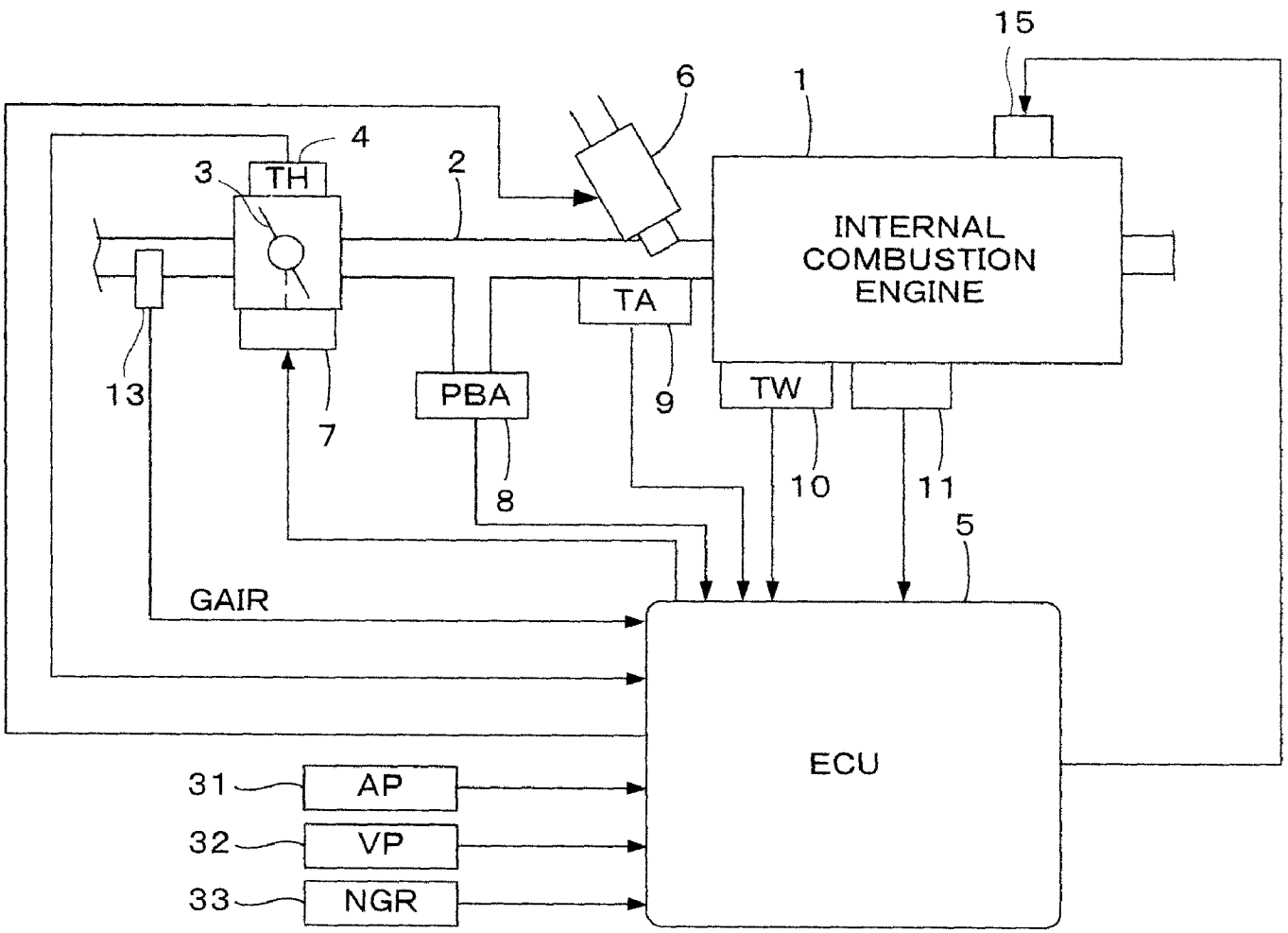

[FIG. 2]
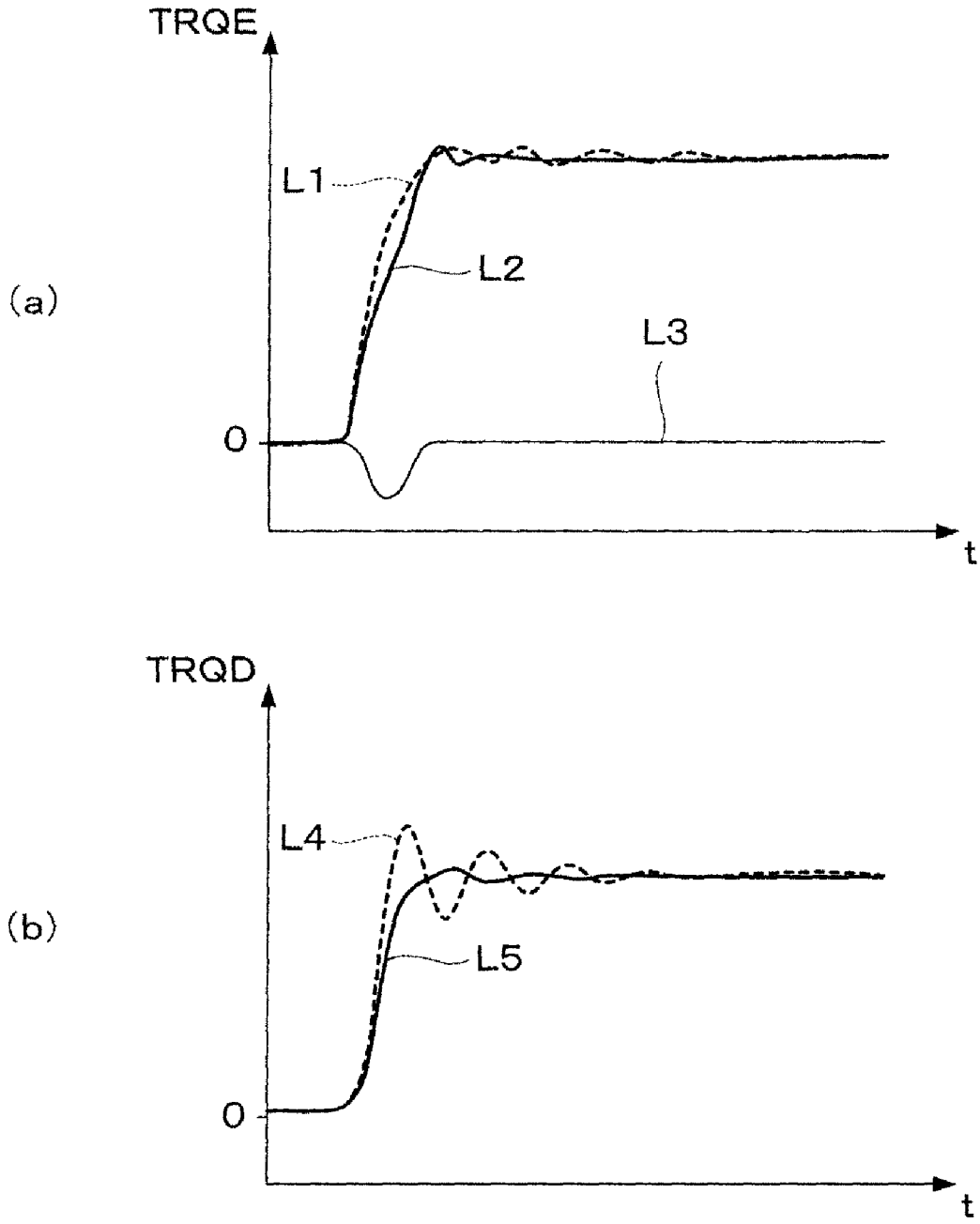

[FIG. 3]
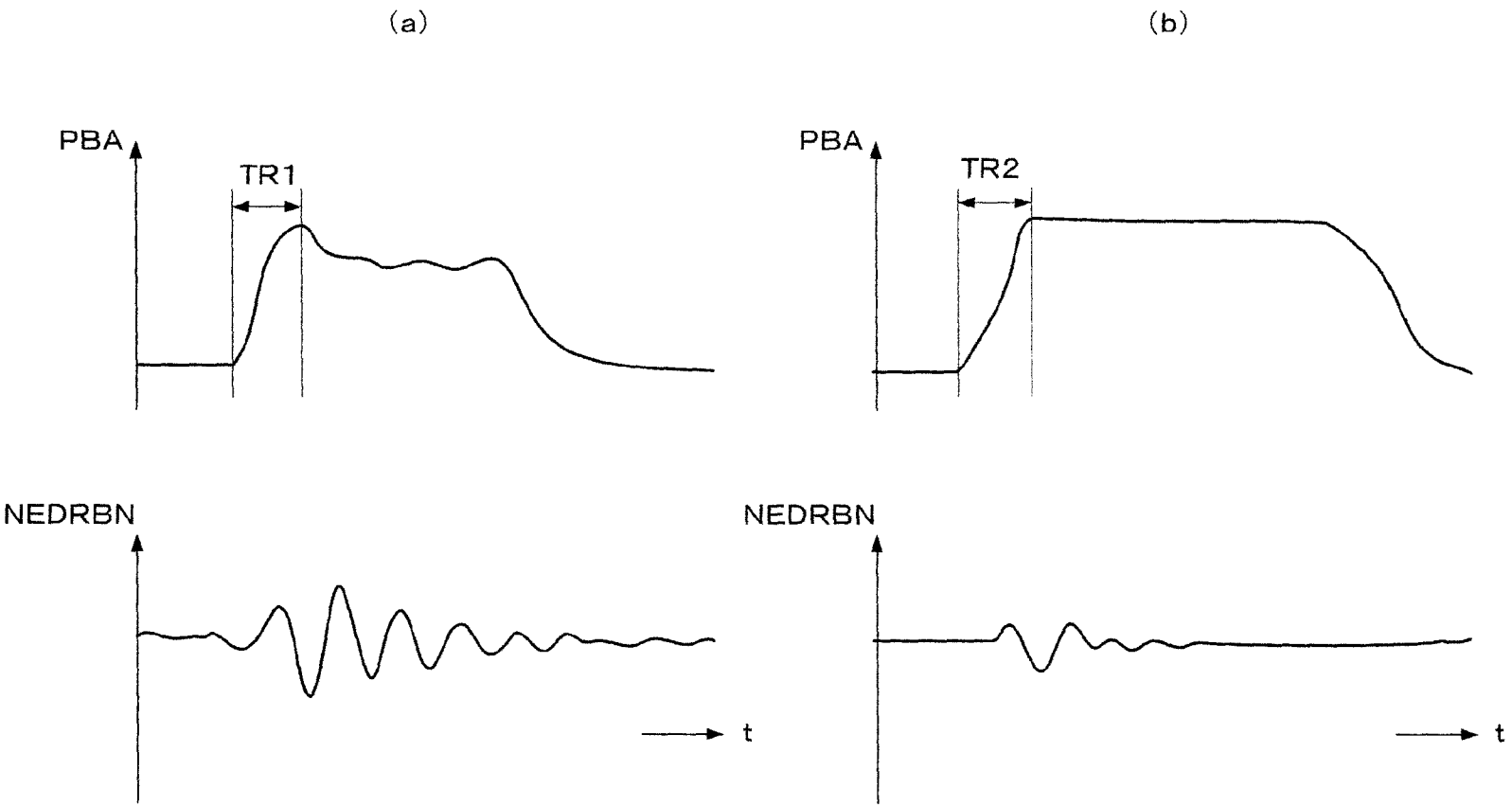

[FIG. 4]
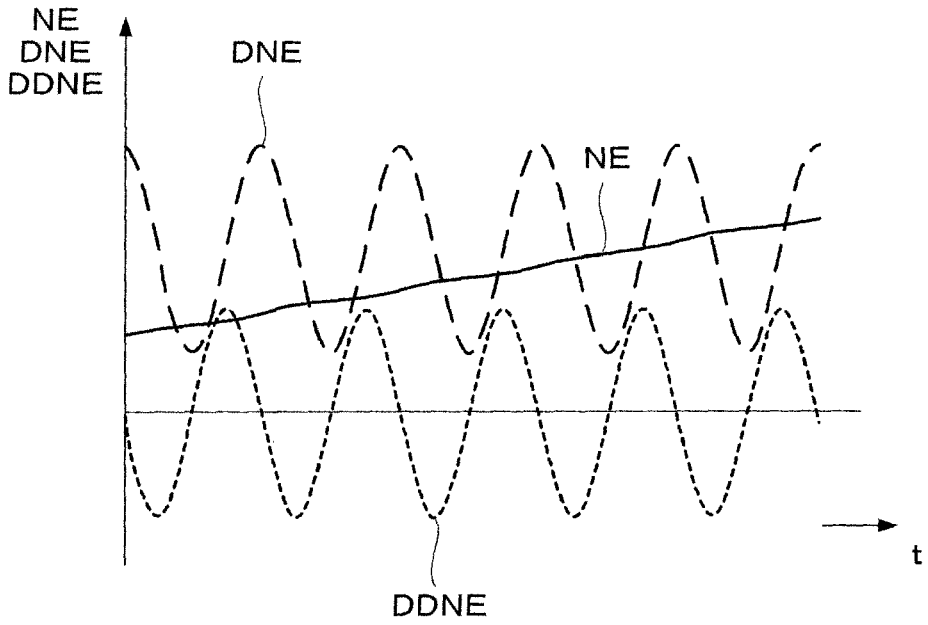
[FIG. 5]
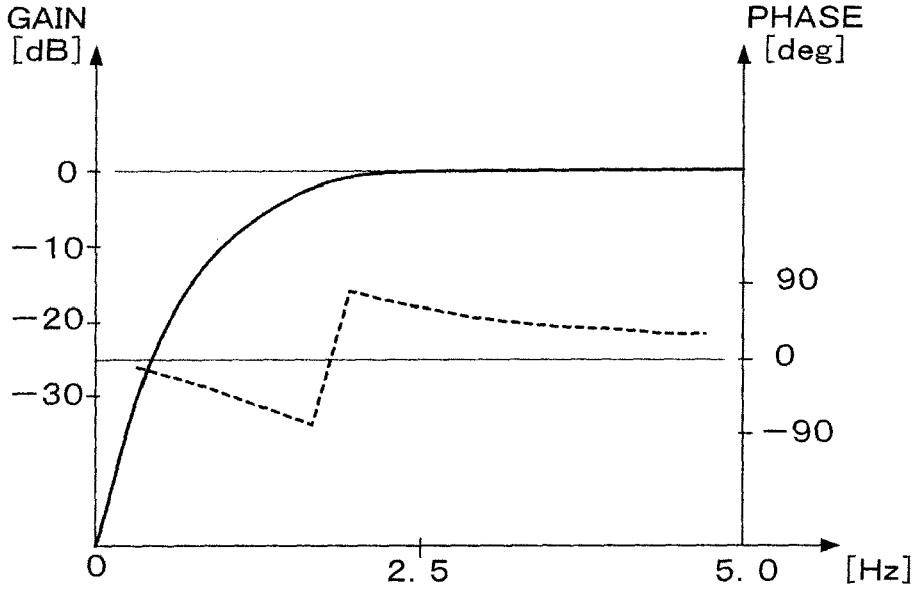

[FIG. 6]
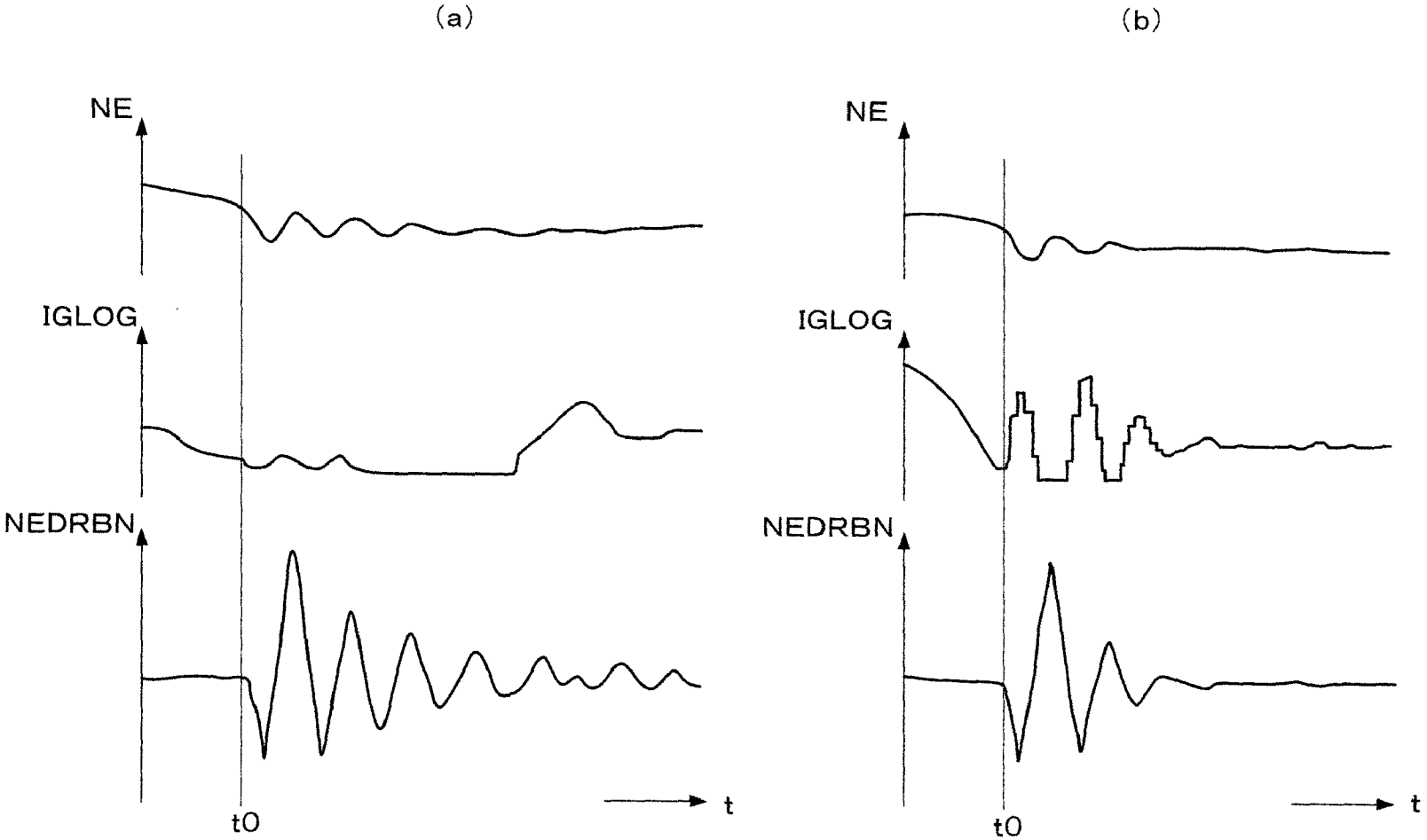

[FIG. 7]
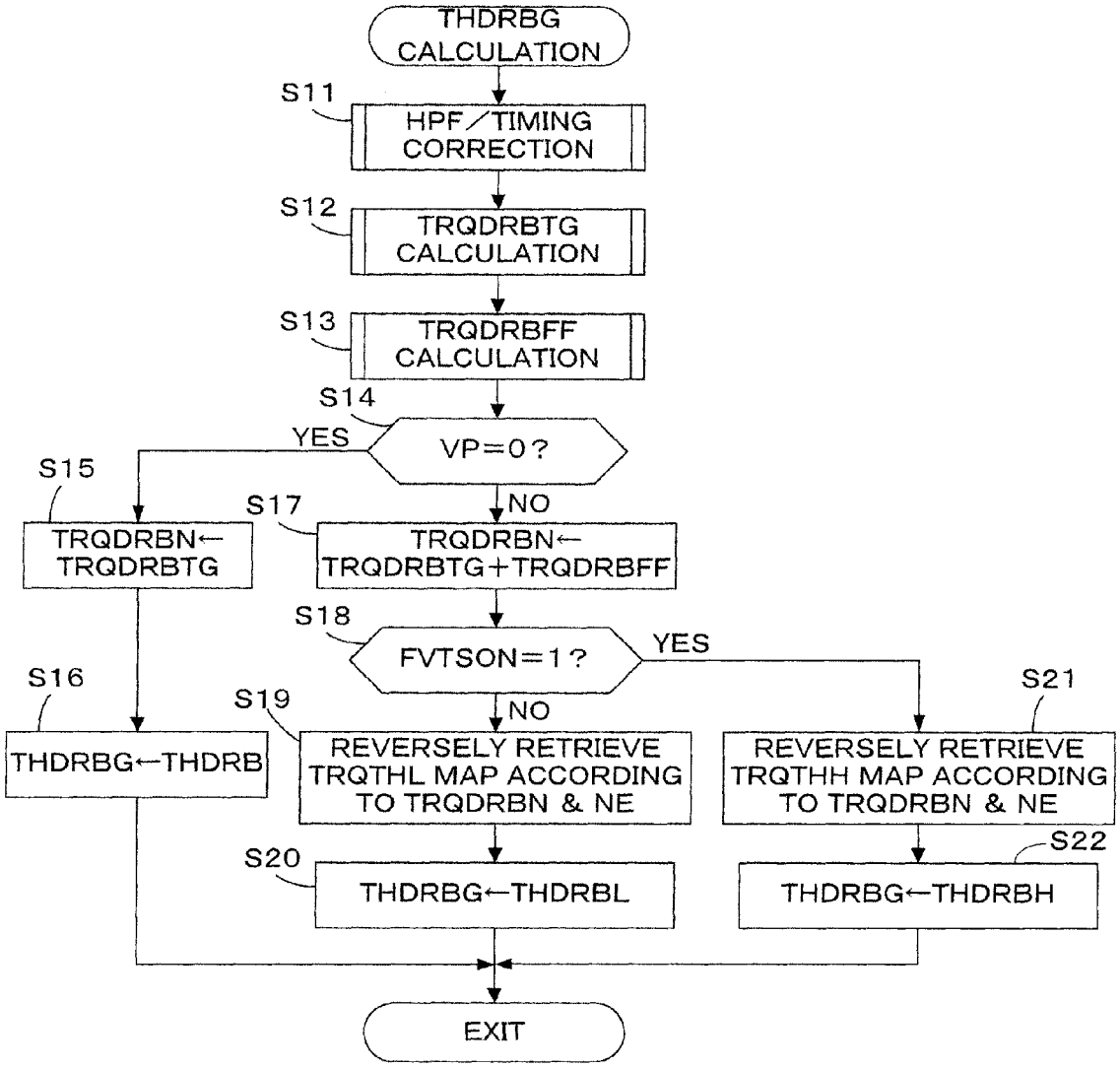

[FIG. 8]
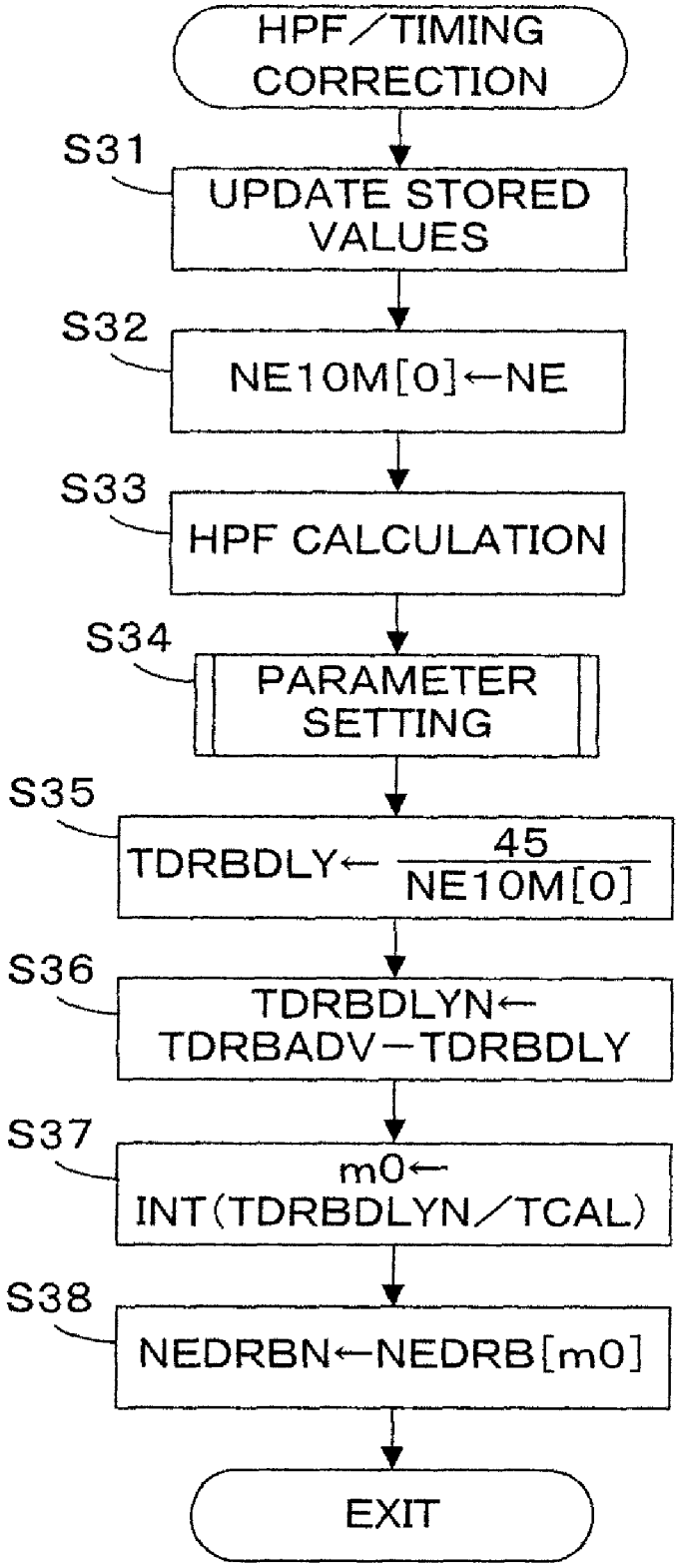

[FIG. 9]
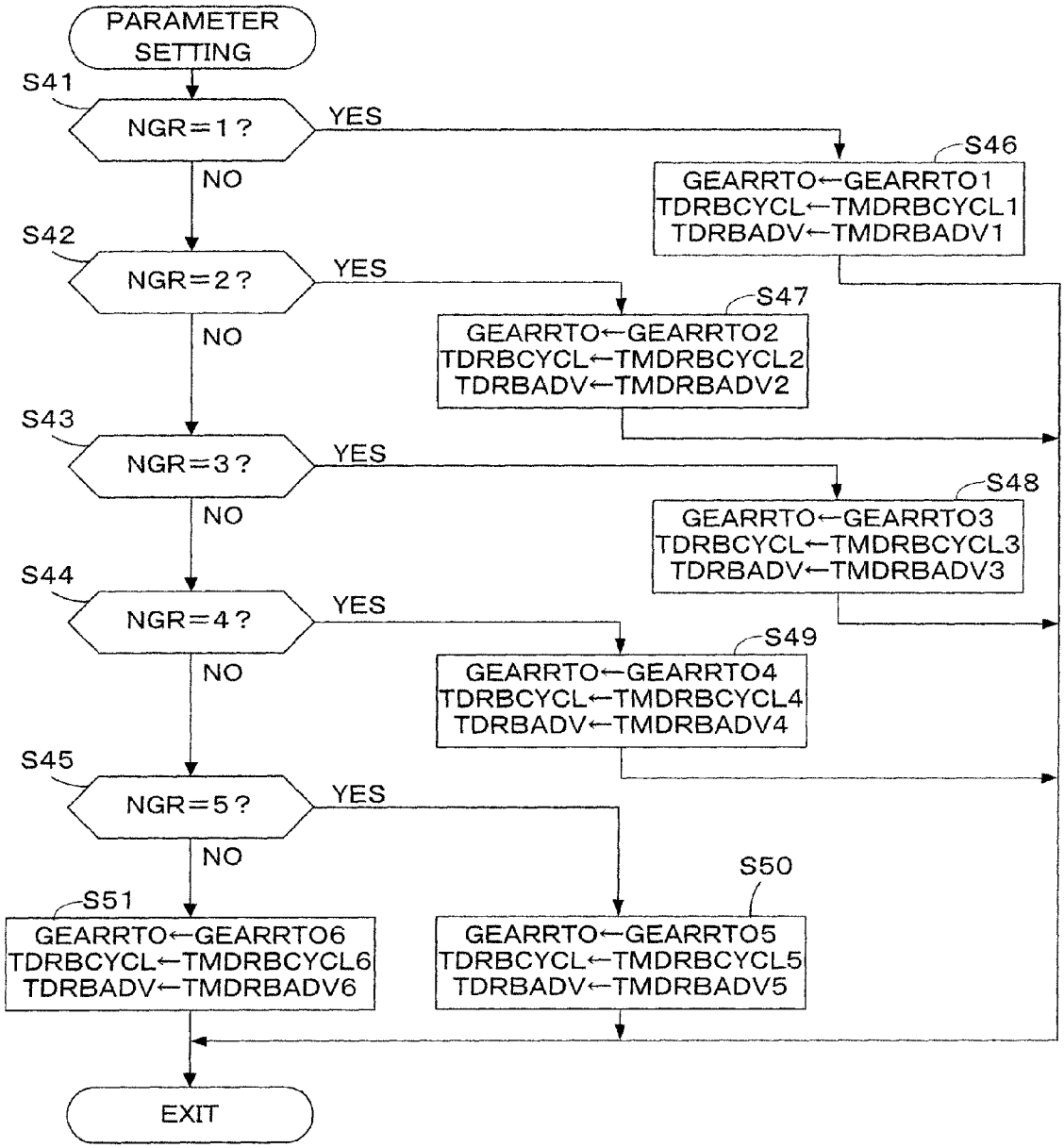

[FIG. 10]
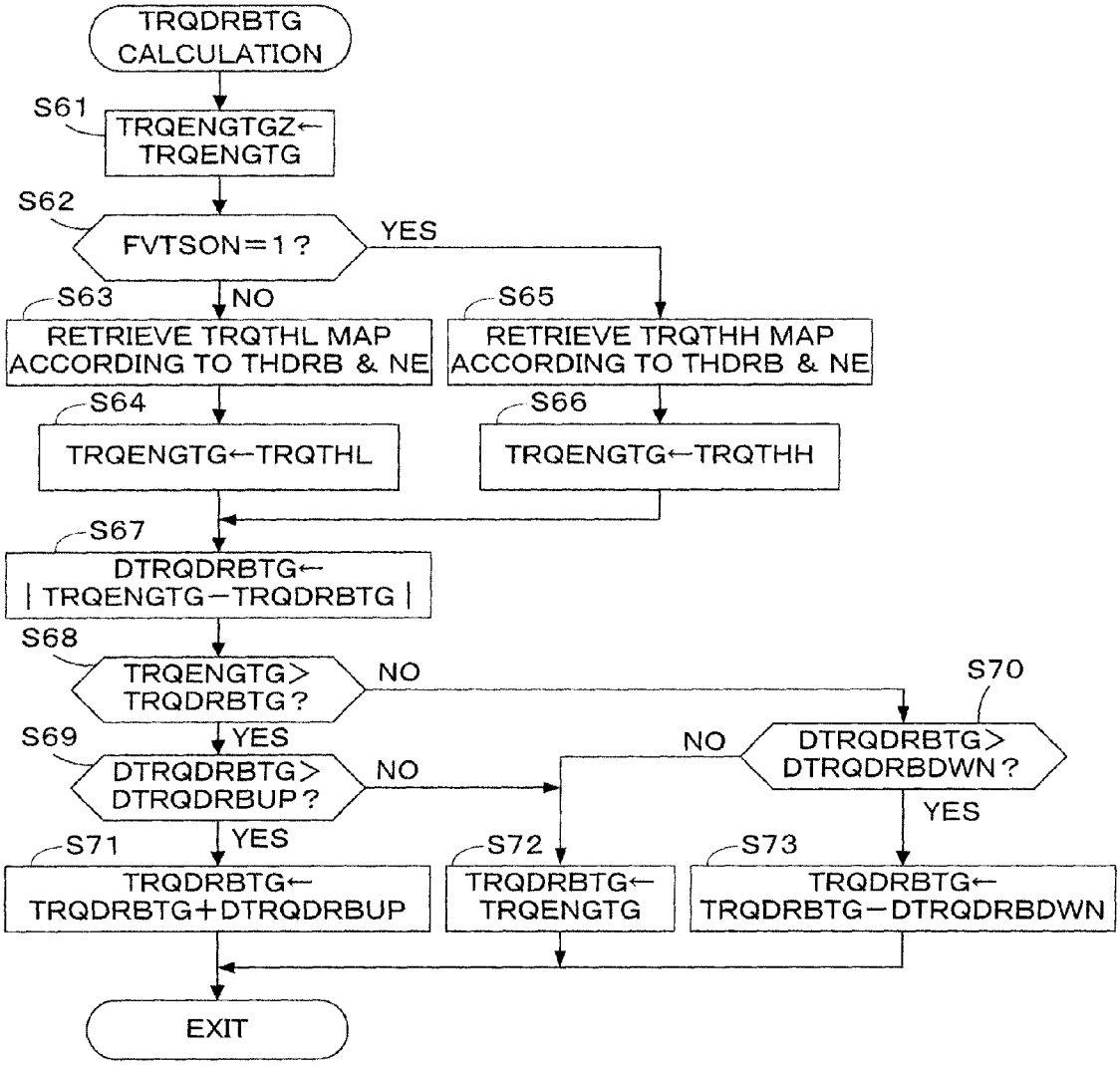

[FIG. 11]
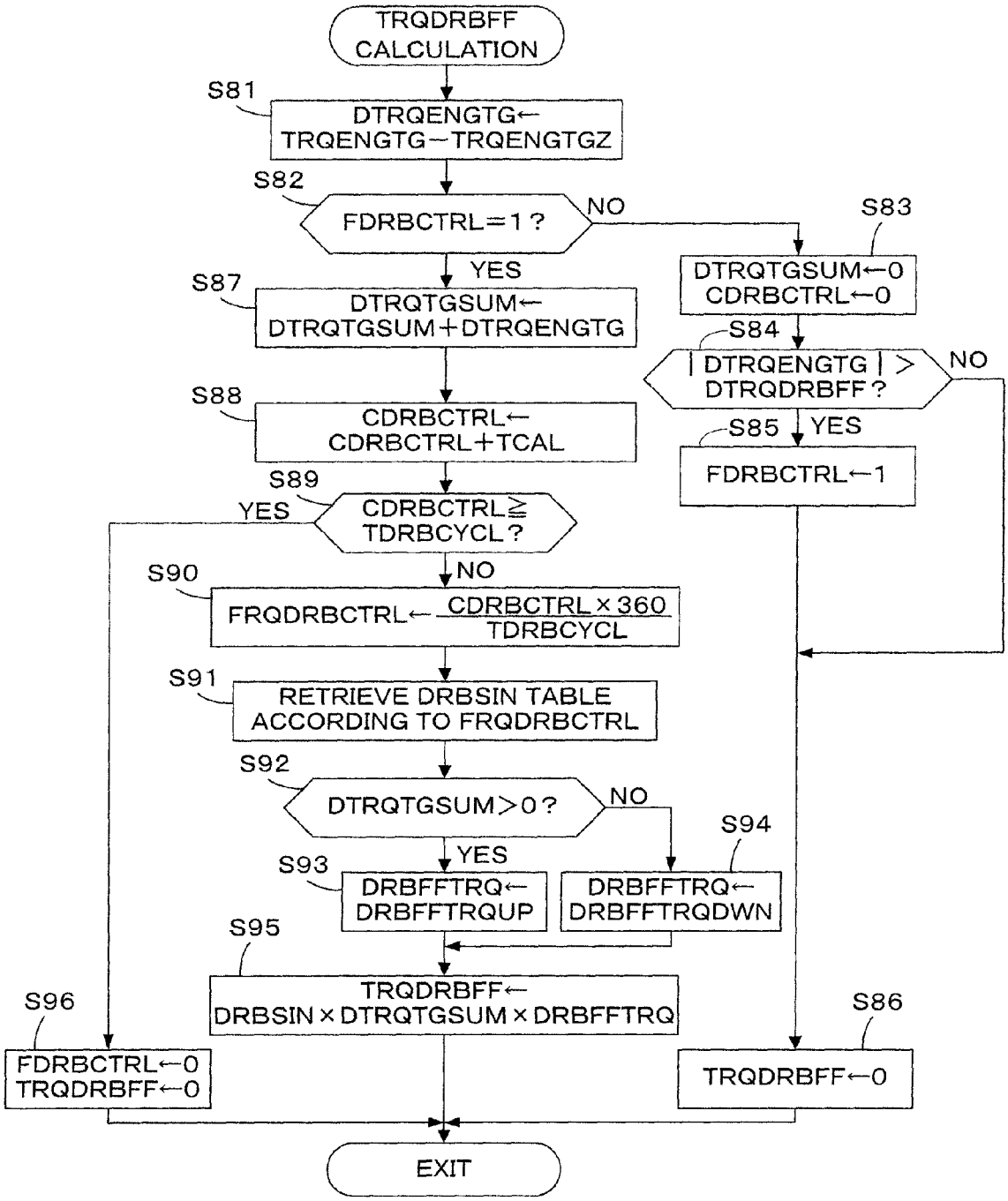

[FIG. 12]
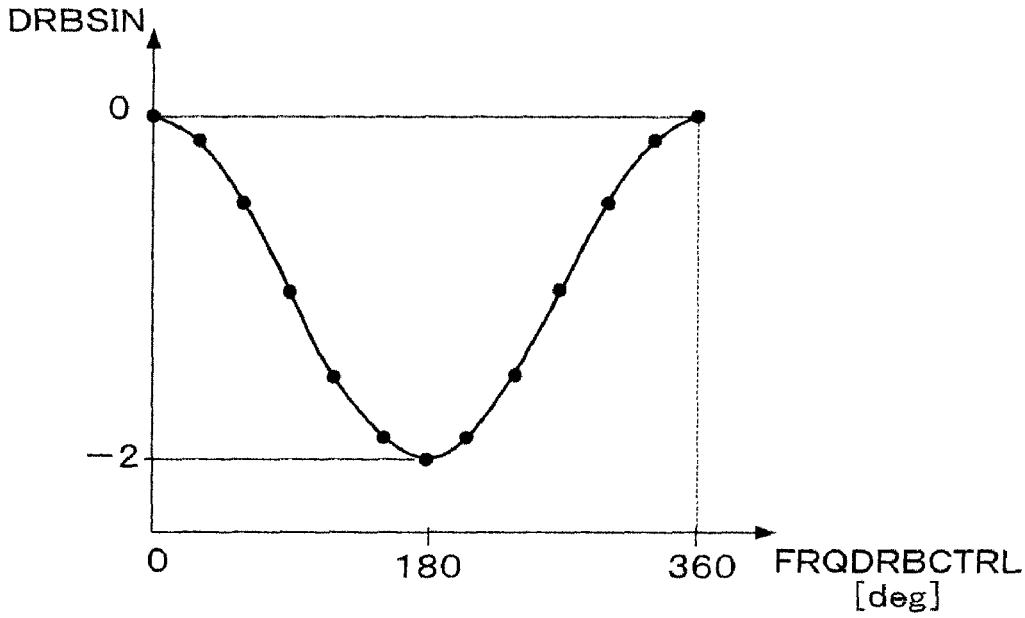
[FIG. 13]
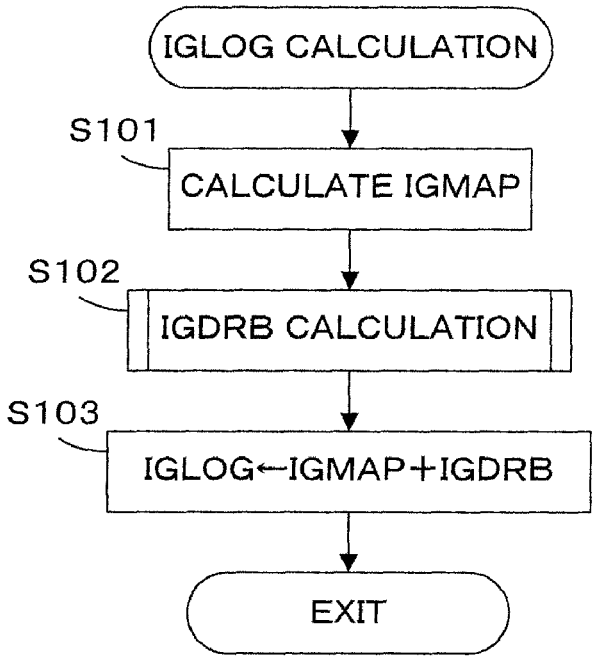

[FIG. 14]
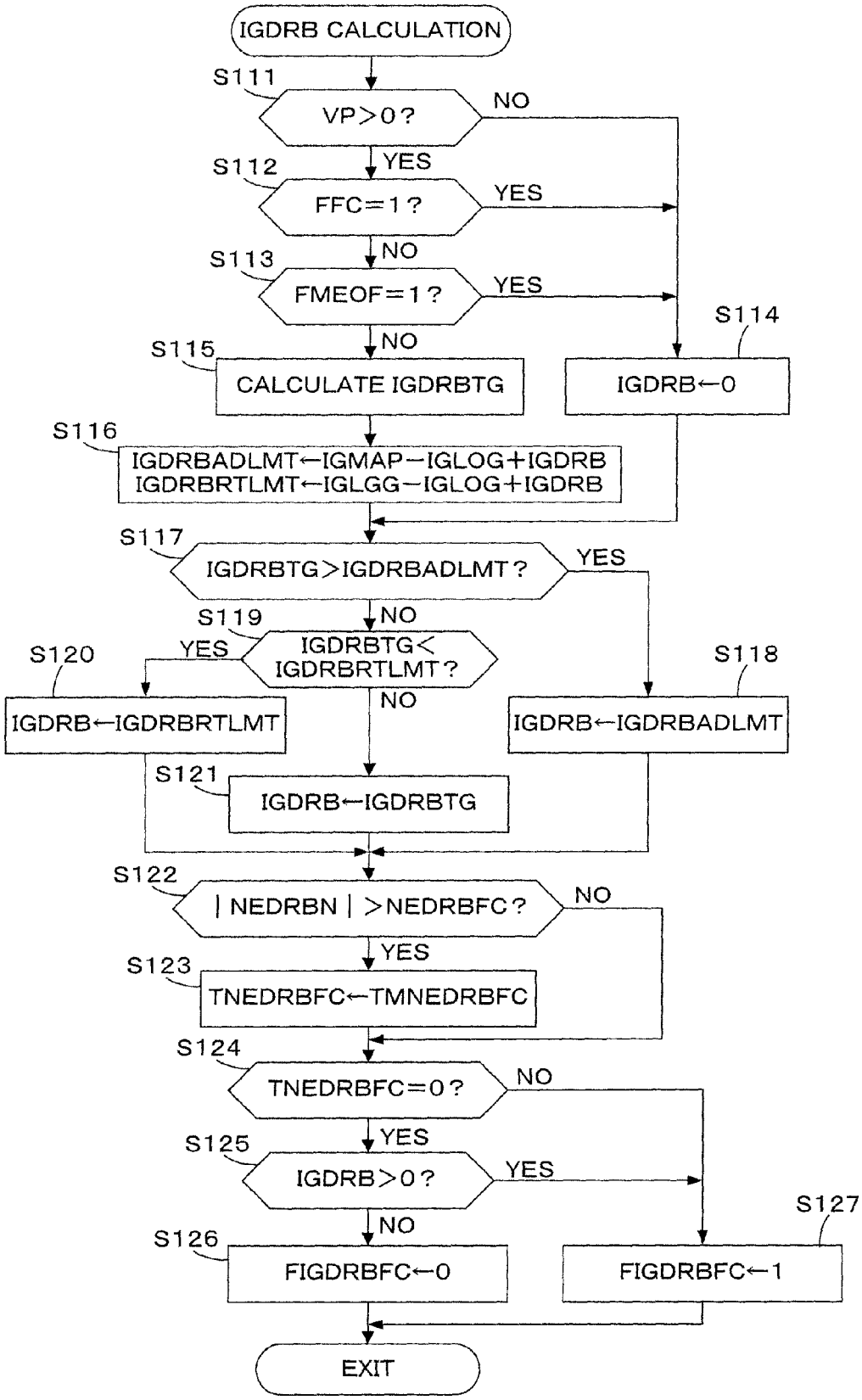

[FIG. 15]
(a)
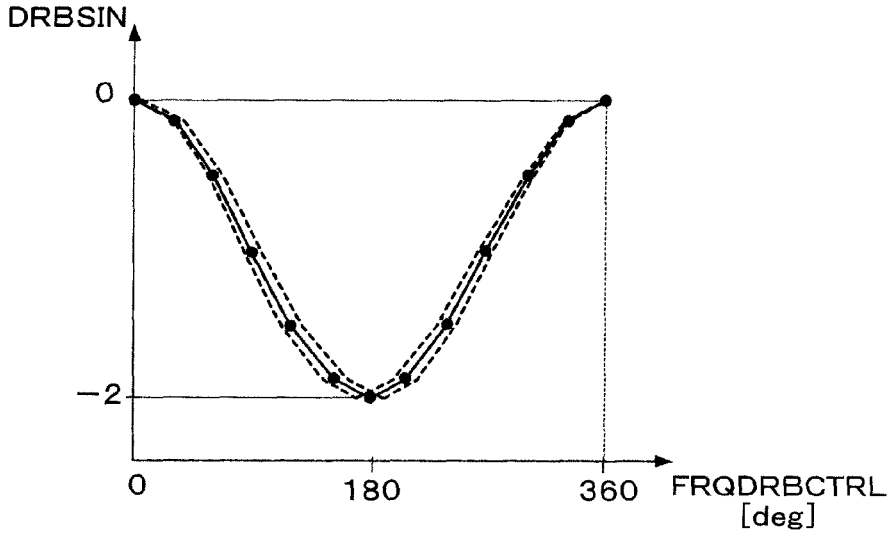
(b)
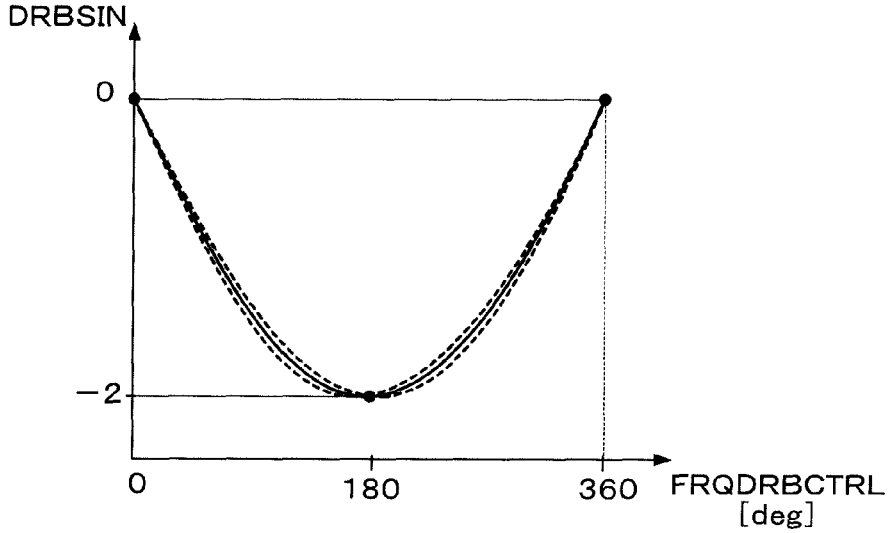
(c)
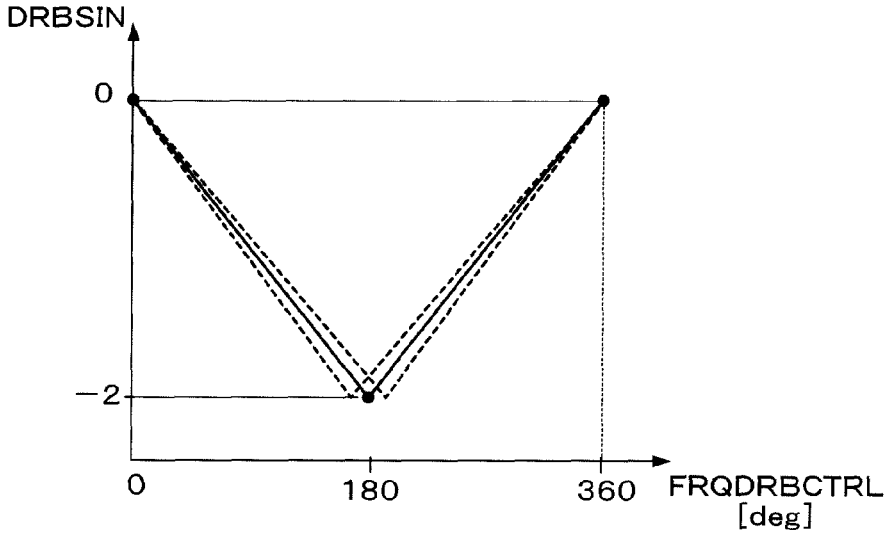

CONTROL SYSTEM FOR INTERNAL COMBUSTION ENGINE

TECHNICAL FIELD

The present invention relates to a control system for an internal combustion engine which drives a vehicle, and particularly to a control system which suppresses vibration of the vehicle caused by changes in the output torque of the internal combustion engine.

BACKGROUND ART

The patent document 1 described below discloses a throttle control device which controls an opening of the throttle valve so as to suppress vibration of a vehicle powertrain generated upon operation of the accelerator pedal. According to this device, an inverse filter control for suppressing the vibration of the powertrain and another control (e.g., a retard control of the ignition timing) for suppressing the vibration are performed so as not to interfere with each other. The inverse filter control is a control in which a throttle valve opening command value is calculated from an accelerator opening using a phase compensator having a transfer characteristic of W (=Gm/Gp), wherein Gp is a transfer characteristic of a drive shaft torque corresponding to the throttle valve opening command value, and Gm is a target transfer characteristic of the drive shaft torque corresponding to the accelerator opening. The transfer characteristic Gp and the target transfer characteristic Gm are preliminarily obtained.

Further, the patent document 2 described below discloses a control device for suppressing vibration of a vehicle. In this control device, a derivative value (derivative acceleration) DA of an acceleration A of a vehicle powertrain is calculated, and the vibration of the vehicle is suppressed by correcting the ignition timing in the retard direction according to the derivative acceleration DA. The derivative acceleration DA is calculated, for example, by twice differentiating the engine rotational speed.

Patent Document 1: Japanese Patent Laid-open No. 2000-205008

Patent Document 2: Japanese Patent Publication No. 2701270

DISCLOSURE OF THE INVENTION

Problems to be Solved by the Invention

The device shown in the patent document 1 performs the phase compensation with respect to the detected accelerator opening using the phase compensator. Accordingly, an amount of calculations in the control device is great. Therefore, it is necessary to use a high-performance processing unit for coping with a state where the accelerator opening rapidly changes and the vibration suppression control is required, which causes a rise in the manufacturing cost. Further, according to the device shown in the patent document 1, there is another problem that the man power for designing the phase compensator becomes great.

Further, in the device shown in the patent document 2, the effect of suppressing the vibration may not be sufficiently obtained due to a detection delay and a calculation delay of the derivative acceleration DA. Further, since the influence of the detection delay or the calculation delay changes depending on the rotational speed of the engine, it is difficult to obtain a good effect of suppressing the vibration in all engine operating conditions.

The invention was made contemplating the above-described points, and a first object of the present invention is to provide a control system for an internal combustion engine, which can obtain a great effect of suppressing the vibration with comparatively simple calculation when the demand torque to the engine rapidly changes.

Further, a second object of the present invention is to provide a control system for an internal combustion engine, which can improve a performance of suppressing the vibration of the vehicle powertrain generated upon rapid change in the torque applied to the output shaft of the engine.

Means for Solving the Problems

To attain the first object, the present invention provides a first control system for an internal combustion engine for driving a vehicle, which controls an output torque of the engine. The control system is characterized by including torque change detecting means, feedforward correction amount generating means, and feedforward torque correcting means. The torque change detecting manes detects a rapid change in a demand torque (TRQENGTG) of the engine. The feedforward correction amount generating means generates a feedforward correction amount (TRQDRBFF) during a correction period which is substantially equal to a resonance period (TDRBCYCL) of a powertrain of the vehicle, from a time when the rapid change in the demand torque is detected. The feedforward torque correcting means corrects an output torque control amount (THDRBG) of the engine with the feedforward correction amount (TRQDRBFF).

With this configuration, the feedforward correction amount is generated during the correction period which is substantially equal to the resonance period of the vehicle powertrain, from the time the rapid change in the demand torque is detected, and the output torque control amount of the engine is corrected with the generated feedforward correction amount. By performing the feedforward correction during the correction period substantially equal to the resonance period, the vibration of the vehicle powertrain can be effectively suppressed while the output torque changing characteristic of the engine is maintained at the almost same level. Further, a negative effect, such that the vibration is conversely enlarged due to too long period of performing the feedforward correction, is not caused.

Preferably, the feedforward correction amount generating means generates the feedforward correction amount (TRQDRBFF) so that the output torque control amount (THDRBG) is corrected in a direction opposite to a direction of the change in the demand torque from a time when the rapid change in the demand torque is detected, to a half-period elapsed time when a time period which is substantially equal to a half of the resonance period (TDRBCYCL) has elapsed, and the output torque control amount (THDRBG) is corrected in a direction equal to the direction of the change in the demand torque after the half-period elapsed time.

With this configuration, the feedforward correction amount is generated so that the output torque control amount is corrected in the direction opposite to the direction of the change in the demand torque from the time the rapid change in the demand torque is detected, to the half-period elapsed time when the time period which is substantially equal to a half of the resonance period has elapsed, and the output torque control amount is corrected in the direction equal to the direction of the change in the demand torque after the half-period elapsed time. According to this setting of the time period during which the feedforward correction amount is applied, the vibration caused by the rapid change in the demand torque can be effectively suppressed.

Preferably, the feedforward correction amount generating means calculates a torque change amount integrated value (DTRQTGSUM) by integrating an amount (DTRQENGTG) of change in the demand torque, and generates the feedforward correction amount (TRQDRBFF) according to the torque change amount integrated value (DTRQTGSUM).

With this configuration, the torque change amount integrated value is calculated by integrating an amount of change in the demand torque, and the feedforward correction amount is generated according to the torque change amount integrated value. According to this control, the feedforward correction amount can be set to an appropriate value.

Preferably, the feedforward correction amount generating means calculates the feedforward correction amount (TRQDRBFF) according to a direction of change in the demand torque.

With this configuration, the feedforward correction amount is calculated according to the direction of change in the demand torque, i.e., according to whether the demand torque increases or decreases. In the transient state where the demand torque is decreasing, it is preferable to set the absolute value of the feedforward correction amount to a less value than a value corresponding to the transient state where the demand torque is increasing, since it is necessary to set the feedforward correction amount so that the engine rotational speed does not increase. According to this control, the correction can be performed suitably in each transient state.

To attain the second object, the present invention provides a second control system for an internal combustion engine for driving a vehicle, which controls an output torque of the engine. The control system includes rotational speed detecting means, high-pass filtering means, and feedback torque correcting means. The rotational speed detecting means detects a rotational speed (NE) of the engine. The high-pass filtering means performs a high-pass filtering of the detected engine rotational speed (NE). The feedback torque correcting means corrects an output torque control amount (IGLOG) of the engine in a feedback manner according to the high-pass filtered engine rotational speed (NEDRBN).

With this configuration, the high-pass filtering of the detected engine rotational speed is performed, and the output torque control amount of the engine is corrected in the feedback manner according to the high-pass filtered engine rotational speed. The component corresponding to the second-order derivative value of the engine rotational speed (the component indicative of changes in the engine output torque) can be extracted by the high-pass filtering. In addition, the phase of the filtered output can be advanced in the pass band of the high-pass filtering. Therefore, the delay of detecting the component indicative of changes in the engine output torque can be reduced greatly, compared with the conventional method of the subtracting calculation. Consequently, the effect of suppressing vibration of the vehicle powertrain can be improved.

Preferably, the feedback torque correcting means corrects the output torque control amount (IGLOG) so that the high-pass filtered engine rotational speed (NEDRB) becomes "0".

With this configuration, the output torque control amount is corrected so that the high-pass filtered engine rotational speed becomes "0". The high-pass filtered engine rotational speed indicates changes in the engine output torque. Therefore, by performing the feedback correction of the output torque control amount so as to make the high-pass filtered engine rotational speed become "0", the vibration of the vehicle powertrain can be suppressed effectively.

Preferably, a cutoff frequency of the high-pass filtering is set to a frequency lower than a resonance frequency ($\omega 0$) of a powertrain of the vehicle. With this setting of the cutoff frequency, the resonance frequency component of the vibration of the vehicle powertrain can be extracted, thereby effectively suppressing the resonance frequency component.

Preferably, the second control system further includes timing correcting means for performing a timing correction of the high-pass filtered engine rotational speed (NEDRB), wherein the feedback torque correcting means corrects the output torque control amount (IGLOG) according to the engine rotational speed (NEDRBN) corrected by the timing correcting means.

With this configuration, the timing correction of the high-pass filtered engine rotational speed is performed, and the output torque control amount is corrected according to the timing-corrected engine rotational speed. Since the phase of the component indicative of changes in the engine output torque is advanced by the high-pass filtering, the timing correction for canceling the detection delay of the engine rotational speed and the like can be performed. By performing the timing correction, the effect of suppressing the vibration obtained by the feedback correction can be improved.

Preferably, the timing correcting means performs the timing correction according to a phase advance (TDRBADV) caused by the high-pass filtering, a detection delay of the rotational speed detecting means, and a torque change delay (TDRBDLY) which corresponds to a time period from a change in the output torque control amount to a change in the output torque of the engine caused by the change in the output torque control amount.

With this configuration, the timing correction is performed according to the phase advance caused by the high-pass filtering, the detection delay of the rotational speed detecting means, and the torque change delay which corresponds to a time period from a change in the output torque control amount to a change in the output torque of the engine caused by the change in the output torque control amount. By taking the phase advance caused by the high-pass filtering, the detection delay of the engine rotational speed, and the torque change delay into consideration, the timing correction can be performed accurately.

Preferably, the timing correcting means calculates an advance time period (TDRBADV) corresponding to the phase advance caused by the high-pass filtering, according to a gear ratio (GEARRTO) of a transmission connected to an output shaft of the engine, and performs the timing correction using the calculated advance time period (TDRBADV).

With this configuration, the advance time period corresponding to the phase advance caused by the high-pass filtering is calculated according to the gear ratio of the transmission connected to the output shaft of the engine, and the timing correction is performed using the calculated advance time period. Since the resonance frequency of the vehicle powertrain changes depending on the gear ratio, the phase advance caused by the high-pass filtering changes depending on the gear ratio. Therefore, by calculating the advance time period according to the gear ratio, an accurate value of the advance time period can be obtained corresponding to the phase advance caused by the high-pass filtering.

Preferably, the feedback torque correcting means sets a gain of the feedback correction according to a gear ratio (GEARRTO) of a transmission connected to an output shaft of the engine and an intake air flow rate (GAIRCYL) of the engine.

With this configuration, the feedback correction gain is set according to the gear ratio of the transmission and the intake air flow rate of the engine. The resonance frequency of the vehicle powertrain changes depending on the gear ratio, and the changing characteristic of the engine output torque versus changes in the output torque control amount varies depending on the intake air flow rate. Therefore, by setting the feedback correction gain according to the gear ratio and the intake air flow rate, the correction can be performed appropriately.

Preferably, the second control system further includes inhibiting means for inhibiting a fuel cut operation in which a fuel supply to the engine is stopped, when the feedback torque correcting means corrects the output torque control amount (IGLOG) in a direction of increasing the output torque (IGDRB>0).

With this configuration, the fuel cut operation is inhibited when the output torque control amount is corrected in the direction of increasing the output torque. Therefore, the vibration of the vehicle powertrain can be prevented from increasing due to the fuel cut operation.

Preferably, the second control system further includes the torque change detecting means, the feedforward correction amount generating means, and the feedforward torque correcting means, which are included in the first control system.

With this configuration, the feedforward correction amount is generated during the correction period which is substantially equal to the resonance period of the vehicle powertrain from the time when the rapid change in the demand torque of the engine is detected, and the output torque control amount of the engine is corrected with the feedforward correction amount. Therefore, the vibration of the vehicle powertrain can be effectively suppressed while the output torque changing characteristic of the engine is maintained at the almost same level. Further, a negative effect, such that the vibration is conversely enlarged due to too long period of performing the feedforward correction, is not caused.

To attain the first and second objects, the present invention provides a third control system for an internal combustion engine for driving a vehicle, which controls an output torque of the engine. The control system includes torque change detecting means, feedforward correction amount generating means, feedforward torque correcting means, rotational speed detecting means, high-pass filtering means, and feedback torque correcting means. The torque change detecting means detects a rapid change in a demand torque of the engine. The feedforward correction amount generating means generates a feedforward correction amount during a correction period which is substantially equal to a resonance period of a powertrain of the vehicle from a time when the rapid change in the demand torque is detected. The feedforward torque correcting means for correcting a first output torque control amount (THDRBG) of the engine with the feedforward correction amount. The rotational speed detecting means detects a rotational speed of the engine. The high-pass filtering means performs a high-pass filtering of the detected engine rotational speed. The feedback torque correcting means corrects a second output torque control amount (IGLOG) of the engine in a feedback manner according to the high-pass filtered engine rotational speed.

With this configuration, the feedforward correction amount is generated during the correction period which is substantially equal to the resonance period of the vehicle powertrain from the time when the rapid change in the demand torque of the engine is detected; the high-pass filtering of the detected engine rotational speed is performed; the first output torque control amount of the engine is corrected with the feedforward correction amount; and the second output torque control amount of the engine is corrected in the feedback manner according to the high-pass filtered engine rotational speed. Therefore, the vibration of the vehicle powertrain can be effectively suppressed while the output torque changing characteristic of the engine is maintained at the almost same level. Further, a negative effect, such that the vibration is conversely enlarged due to too long period of performing the feedforward correction, is not caused. Further, the delay of detecting the component indicative of changes in the engine output torque can be reduced greatly. Consequently, the effect of suppressing vibration of the vehicle powertrain can be improved.

BRIEF DESCRIPTION OF THE DRAWINGS

FIG. 1 shows a configuration of an internal combustion engine and a control system therefor according to an embodiment of the present invention;

FIG. 2 shows time charts for illustrating the feedforward torque control;

FIG. 3 shows time charts for illustrating an effect of the feedforward torque control;

FIG. 4 is a time chart showing changes in an engine rotational speed (NE), a first-order derivative value (DNE) of the engine rotational speed, and a second-order derivative value (DDNE) of the engine rotational speed;

FIG. 5 illustrates a frequency characteristic of a high-pass filtering of the engine rotational speed;

FIG. 6 shows time charts for illustrating an effect of the feedback torque control;

FIG. 7 is a flowchart of a process for calculating a throttle valve opening command value (THDRBG);

FIG. 8 is a flowchart of an HPF/timing correction process executed in the process of FIG. 7;

FIG. 9 is a flowchart of a parameter setting process executed in the process of FIG. 8;

FIG. 10 is a flowchart of a basic torque (TRQDRBTG) calculation process executed in the process of FIG. 7;

FIG. 11 is a flowchart of a feedforward correction amount (TRQDRBFF) calculation process executed in the process of FIG. 7;

FIG. 12 illustrates a table referred to in the process of FIG. 11;

FIG. 13 is a flowchart of the ignition timing (IGLOG) calculation process;

FIG. 14 is a flowchart of a process for calculating a feedback correction amount (IGDRB), executed in the process of FIG. 13; and FIG. 15 illustrates modifications of the table shown in FIG. 12.

DESCRIPTION OF REFERENCE NUMERALS

1 Internal combustion engine
3 Throttle valve
5 Throttle valve opening sensor
5 Electronic control unit (torque change detecting means, rotational speed detecting means, feedforward correction amount generating means, feedforward torque correcting means, high-pass filtering means, feedback torque correcting means, timing correcting means, inhibiting means)
7 Actuator
11 Crank angle position sensor (rotational speed detecting means)
15 Spark plug
31 Accelerator sensor (torque change detecting means)
33 Shift position sensor

BEST MODE FOR CARRYING OUT THE INVENTION

Preferred embodiments of the present invention will now be described with reference to the drawings.

FIG. 1 is a schematic diagram showing a configuration of an internal combustion engine and a control system therefor according to one embodiment of the present invention. In FIG. 1, the internal combustion engine 1 (hereinafter referred to as "engine") for example, has 4 cylinders, and has an intake pipe 2 provided with a throttle valve 3. A throttle valve opening (TH) sensor 4 is connected to the throttle valve 3, so as to output an electrical signal corresponding to an opening of the throttle valve 3 and supply the electrical signal to an electronic control unit (hereinafter referred to as (ECU)) 5. An actuator 7 for actuating the throttle valve 3 is connected to the throttle valve 3, and the operation of the actuator 7 is controlled by the ECU 5.

An intake air flow rate sensor 13 for detecting an intake air flow rate GAIR of the engine 1 is disposed in the intake pipe 2. The detection signal of the intake air flow rate sensor 13 is supplied to the ECU 5.

Fuel injection valves 6 are inserted into the intake pipe 2 at locations intermediate between the cylinder block of the engine 1 and the throttle valves 3 and slightly upstream of the respective intake valves (not shown). These fuel injection valves 6 are connected to a fuel pump (not shown), and electrically connected to the ECU 5. A valve opening period of each fuel injection valve 6 is controlled by a signal output from the ECU 5. A spark plug 15 is provided in each cylinder of the engine 1. Each spark plug 15 is connected to the ECU 5, and an ignition timing of each spark plug 15 is controlled by the ECU 5.

An intake pressure sensor 8 for detecting an intake pressure PBA and an intake air temperature sensor 9 for detecting an intake air temperature TA are disposed downstream of the throttle valve 3. An engine coolant temperature sensor 10 for detecting an engine coolant temperature TW is mounted on the body of the engine 1. The detection signals from these sensors are supplied to the ECU 5.

A crank angle position sensor 11 is connected to the ECUS. The crank angle position sensor is provided to detect a rotational angle of the crankshaft (not shown) of the engine 1. A signal corresponding to the rotational angle of the crankshaft is supplied to the ECU 5. The crank angle position sensor 11 of generates one pulse (hereinafter referred to as "CRK pulse") at every constant crank angle period (e.g., a period of 30 degrees). Further, the crank angle position sensor 11 generates a pulse at every predetermined crank angle position for a specific cylinder of the engine 1 (this pulse will be hereinafter referred to as "CYL pulse") and a pulse at a top dead center (TDC) starting the intake stroke in each cylinder (this pulse will be hereinafter referred to as "TDC pulse"). These pulses are used for control of various timing such as a fuel injection timing and an ignition timing, and for detection of an engine rotational speed NE.

An accelerator sensor 31, a vehicle speed sensor 32, and a shift position sensor 33 are also connected to the ECU 5. The accelerator sensor 31 detects a depression amount AP of an accelerator pedal of the vehicle driven by the engine 1 (this depression amount will be referred to as "accelerator operation amount"). The vehicle speed sensor 32 detects a running speed (vehicle speed) VP of the vehicle. The shift position sensor 33 detects a shift position (gear position) NGR of a transmission connected to the crankshaft (output shaft) of the engine 1. The detection signals from these sensors are supplied to the ECU 5.

The ECU 5 includes an input circuit, a central processing unit (hereinafter referred to as "CPU"), a memory circuit, and an output circuit. The input circuit performs various functions including shaping the waveforms of input signals from various sensors, correcting the voltage levels of the input signals to a predetermined level, and converting analog signal values into digital values. The memory circuit preliminarily stores various operating programs to be executed by the CPU and stores the results of computations or the like by the CPU. The output circuit supplies drive signals to the actuator 7, the fuel injection valve 6, and the spark plug 15.

The CPU in the ECU 5 performs a control of an opening of the throttle valve 3, a control of an amount of fuel to be supplied to the engine 1 (the opening period of each fuel injection valve 6), and a control of an ignition timing of each spark plug 15, according to the detected signals from the above-described sensors.

The engine 1 is provided with a valve timing varying mechanism which switches the valve timing (specifically a lift amount and a valve opening period) of intake valves and exhaust valves, which are not shown, between a low-speed valve timing suitable for a low rotational speed region of the engine and a high-speed valve timing suitable for a high rotational speed region. The ECU 5 performs a switching control of the valve timing according to the operating condition of the engine 1.

In this embodiment, a feedforward torque control (hereinafter referred to as "FF torque control") and a feedback torque control (hereinafter referred to as "FB torque control") are performed in order to suppress the vibration caused by the resonance of the vehicle powertrain including the crankshaft of the engine 1, a transmission, a drive shaft, and driving wheels of the vehicle.

FIGS. 2 and 3 shows time charts for illustrating the FF torque control. FIG. 2(*a*) shows changes in the output torque TRQE of the engine 1 when the accelerator pedal is depressed, and FIG. 2(*b*) shows changes in the corresponding drive shaft torque TRQD. The dashed lines L1 and L4 of FIG. 2 indicate changes in the torque when the FF torque control is not performed, and the solid lines L2 and L5 indicate changes in the torque when the FF torque control is performed. Further, the solid line L3 of FIG. 2(*a*) indicates changes in a FF correction amount TRQDRBFF in the FF torque control. The FF correction amount TRQDRBFF is generated during one cycle period of a resonance period TDRBCYCL of the vehicle powertrain, and is added to a basic torque TRQDRBTG calculated according to the accelerator operation amount AP. In the example shown in FIG. 2, the demand torque of the engine 1 increases. Accordingly, the FF correction amount TRQDRBFF takes a negative value, and the basic torque TRQDRBTG is corrected in the direction of decreasing the output torque of the engine 1.

If the resonance frequency of the vehicle powertrain is expressed by "ω0", the resonance period TDRBCYCL is given by the following equation (1). The resonance frequency ω0 is given by the following equation (2). The constant "K" in the equation (2) is given by the equation (3). "Ie" and "Ib" in the equation (2) are respectively an inertia moment of the engine 1 and an inertia moment of the whole powertrain from the output side of the engine 1 to the driving wheels. In the equation (3), "GEARRTO" is a gear ratio of the transmission and "Kd" is a constant indicative of a twist rigidity of the drive shaft.

[Eq. 1]

$$TDRBCYCL = \frac{2\pi}{\omega 0} \quad (1)$$

$$\omega 0 = \frac{1}{2\pi}\sqrt{K\left(\frac{1}{Ie} + \frac{1}{Ib}\right)} \quad (2)$$

$$K = \frac{Kd}{GEARRTO^2} \quad (3)$$

Addition of the FF correction amount TRQDRBFF makes an inclination of the rising characteristic of the engine output torque TRQE (the solid line L2) partially decrease compared with the dashed line L1. However, the vibration of the drive shaft torque TRQD can be greatly reduced without changing a time period which is necessary for the engine output torque to reach the maximum value.

FIG. 3(*a*) and FIG. 3(*b*), which correspond respectively to a case where the FF torque control is performed and a case where the FF torque control is not performed, show changes in the intake pressure PBA and changes in a filtered engine rotational speed NEDRBN (corresponding to a changing component of engine rotation) obtained by a high-pass filtering of the engine rotational speed NE. When comparing FIG. 3(*a*) with FIG. 3(*b*), time periods TR1 and TR2, which are necessary for the intake pressure PBA to reach the maximum value, are substantially the same. Therefore, it is confirmed that the rising characteristic of the intake pressure PBA is not influenced, even if the FF torque control is performed. Further, regarding the filtered engine rotational speed NEDRBN, it is confirmed that changes in the engine rotational speed NE are greatly reduced by the FF torque control.

In this embodiment, the throttle valve opening command value THDRBG is used as an output torque control amount of the FF torque control, and an actual throttle valve opening TH is controlled so as to coincide with the throttle valve opening command value THDRBG.

Next, an outline of the FB torque control is explained with reference to FIGS. 4, 5, and 6. A vibration of the vehicle powertrain is generated when the engine is rapidly accelerated or when the clutch is engaged without making a rotational speed of the drive side coincide with that of the driven side. The vibration can be indicated with changes in the engine torque. Therefore, as shown in the patent document 2, the torque control is conventionally performed according to the second-order derivative value DDNE of the engine rotational speed NE.

However, the detected engine rotational speed NE is actually indicated not with an instantaneous value but with a moving average value of the detected values during one TDC period (for example, the TDC period of a four-cylinder engine corresponds to a period during which the crankshaft rotates 180 degrees, and the TDC period of a six-cylinder engine corresponds to a period when the crankshaft rotates 120 degrees). Therefore, the detected engine rotational speed is obtained with a detection delay of 0.5 TDC period. Further, since the first-order derivative value DNE is actually calculated as a difference value of the two detected values of the engine rotational speed NE, the first-order derivative value is obtained with a delay of 0.5 TDC period, and the second-order derivative value DDNE is obtained with a further delay of 0.5 TDC period. That is, there is a detection delay of 1.5 TDC period in total. Consequently, the torque control performed according to the second-order derivative value DDNE can not sufficiently suppress the vibration of the powertrain.

If the engine rotational speed NE is expressed with the following equation (4), the first-order derivative value DNE and the second-order derivative value DDNE are respectively obtained by the following equations (5) and (6). These parameters are illustrated, for example, in FIG. 4.

$$NE = A \times \sin(\omega 0 t) + Ct \quad (4)$$

$$DNE = A\omega \times \cos(\omega 0 t) + C \quad (5)$$

$$DDNE = -A\omega 0^2 \sin(\omega 0 t) \quad (6)$$

where "A" and "C" are constants.

Referring to the equations (4) and (6), the second-order derivative value DDNE corresponds to a parameter obtained by removing the slope component Ct of the engine rotational speed NE expressed by the equation (4), and multiplying a squared value of the frequency ω0 with a parameter obtained by inversing the sign of the sinusoidal vibration component included in the equation (4). Therefore, by performing the high-pass filtering of the engine rotational speed NE to remove the slope component Ct, the filtered engine rotational speed NEDRBN, which is a parameter corresponding to the second-order derivative value, can be obtained. Therefore, by performing a feedback control of the output torque of the engine 1 so that the filtered engine rotational speed NEDRBN converges to "0", the vibration of the vehicle powertrain can be suppressed. In this embodiment, the parameter corresponding to the second-order derivative value, i.e., the parameter indicative of changes in the output torque, is obtained by the high-pass filtering. Accordingly, the detection delay of one TDC period caused by the subtracting calculation is eliminated, and the detection delay of the parameter indicative of changes in the output torque can be further improved by the phase advance obtained by the high-pass filtering.

Further, by performing a timing correction in which the detection delay (0.5 TDC period) of the engine rotational speed NE and the torque change delay (one TDC period) from the time the output torque control amount (i.e., the ignition timing IGLOG in this embodiment) is changed to the time the output torque of the engine actually changes, are taken into account with the phase advance caused by the high-pass filtering, the effect of suppressing changes in the output torque can be further improved.

FIG. 5 is a Bode diagram showing an example of a frequency characteristic of the high-pass filtering. In FIG. 5, the solid line shows a gain frequency characteristic and the dashed line shows a phase frequency characteristic. The cutoff frequency ωc of the high-pass filtering is set to a frequency which is a little lower than the resonance frequency ω0 of the powertrain. Specifically, since the resonance frequency ω0 of the powertrain changes depending on the gear ratio GEARRTO as indicated by the equations (2) and (3), the cutoff frequency ωc is set to a frequency (e.g., 1.5 Hz) which is a little lower than the minimum resonance frequency ω0MIN. By setting the cutoff frequency ωc as described above, the resonance frequency component of the vibration of the vehicle powertrain is extracted to effectively suppress the resonance frequency component.

In this embodiment, the ignition timing IGLOG is used as the output torque control amount for the FB torque control. The ignition timing IGLOG is controlled in the feedback manner so that the filtered engine rotational speed NEDRBN becomes "0".

FIG. 6 shows time charts for illustrating changes in the engine rotational speed NE, the ignition timing IGLOG, and the filtered engine rotational speed NEDRBN, when changing the shift position from the first position to the second position and rapidly engaging the clutch at time t0. FIG. 6(*a*) corresponds to a case where the ignition timing IGLOG is controlled according to the conventional second-order derivative value DDNE, and FIG. 6(*b*) corresponds to a case where the FB torque control in this embodiment is performed, i.e., a case where the ignition timing feedback control is performed so as to make the filtered engine rotational speed NEDRBN converge to the target value "0". According to this embodiment, it is confirmed that the ignition timing IGLOG greatly changes so that the changes in the filtered engine rotational speed NEDRBN indicative of changes in the output torque can quickly converge.

FIG. 7 is a flowchart of a process for performing the FF torque control described above. This process is executed by the CPU in the ECU 5 at predetermined time intervals TCAL (e.g., 10 milliseconds).

In step S11, a HPF/timing correction process shown in FIG. 8 is executed to calculate the filtered engine rotational speed NEDRBN. In step S12, a TRQDRBTG calculation process shown in FIG. 10 is executed to calculate a basic torque TRQDRBTG according to the accelerator operation amount AP and the engine rotational speed NE. In step S13, a TQDRBFF calculation process shown in FIG. 11 is executed to calculate an FF correction torque TRQDRGFF.

In step S14, it is determined whether or not the vehicle speed VP is equal to "0". If VP is equal to "0", the target torque TRQDRBN is set to the basic torque TRQDRBTG (step S15), and the throttle valve opening command value THDRBG is set to a basic opening command value THDRB (step S16). The basic opening command value THDRB is set so as to increase as the accelerator operation amount AP increase, in a process which is not shown.

If VP is greater than "0" In step S14, the FF correction amount TRQDRBFF is added to the basic torque TRQDRBTG calculated in step S12, to calculate the target torque TRQDRBN (step S17). In step S18, it is determined whether or not a valve timing flag FVTSON is equal to "1". The valve timing flag FVTSON is set to "1" when the high-speed valve timing is selected.

If the answer to step S18 is negative (NO), i.e., the low-speed valve timing is selected, a TRQTHL map is reversely retrieved according to the target torque TRQDRBN and the engine rotational speed NE, to calculate a low-speed target throttle valve opening THDRBL (step S19). The TRQTHL map is a map for calculating a low-speed target torque of the engine according to the throttle valve opening TH and the engine rotational speed NE. The low-speed target throttle valve opening THDRBL, which is a target throttle valve opening for realizing the target torque TRQDRBN, is obtained by reversely retrieving the TRQTHL map according to the target torque TRQDRBN and the engine rotational speed NE. In step S20, the throttle valve opening command value THDRBG is set to the low-speed target throttle valve opening THDRBL.

On the other hand, if the answer to step S18 is affirmative (YES), i.e., the high-speed valve timing is selected, a TRQTHH map is reversely retrieved according to the target torque TRQDRBN and the engine rotational speed NE, to calculate a high-speed target throttle valve opening THDRBH (step S21). The TRQTHH map is a map for calculating a high-speed target torque of the engine according to the throttle valve opening TH and the engine rotational speed NE. The high-speed target throttle valve opening THDRBH, which is a target throttle valve opening for realizing the target torque TRQDRBN, is obtained by reversely retrieving the TRQTHH map according to the target torque TRQDRBN and the engine rotational speed NE. In step S22, the throttle valve opening command value THDRBG is set to the high-speed target throttle valve opening THDRBH.

FIG. 8 is a flowchart of the HPF/timing correction process executed in step S11 of FIG. 7.

In step S31, stored values of the parameters used for the high-pass filtering and the timing correction are updated. Specifically, engine rotational speed stored values NE10M[i] (i=1, 2) are set to NE10M[i−1], and filtered rotational speed stored values NEDRB[m] (m=1 to 10) are set to NEDRB[m−1]. That is, the process for shifting memory addresses of the engine rotational speed stored value NE10M and the filtered rotational speed stored value NEDRB by "1", is performed.

In step S32, the stored value NE10M[0] is set to the latest engine rotational speed NE. The engine rotational speed NE is a moving average value of the values of the engine rotational speed detected during one TDC period immediately before starting this process.

In step S33, the high-pass filtering is performed by the following equation (7), to calculate a present value NEDRB [0] of the filtered rotational speed.

$$NEDRB[0]=CNEA0\times NE10M[0]+CNEA1\times NE10M[1]$$

$$+CNEA2\times NE10M[2]-CNEB1\times NEDRB[1]$$

$$-CNEB2\times NEDRB[2] \quad (7)$$

where CNEA0, CNEA1, CNEA2, CNEB1, and CNEB2 are filtering coefficients which are set so as to obtain the characteristic as shown in FIG. 5.

In step S34, a parameter setting process shown in FIG. 9 is performed wherein the parameters used in the processes described below are set according to the shift position NGR. This parameter setting is performed because that the resonance period (resonance frequency) of the powertrain and the phase advance amount caused by the high-pass filtering change depending on the selected shift position NGR. In this embodiment, the shift position NGR takes values of "1" (first-position) to "6" (sixth-position). Accordingly, it is determined in steps S41 to S45 of FIG. 9 what value the shift position NGR is.

If NOR is equal to "1", the gear ratio GEARRTO is set to a gear ratio GEARRTO1 of the first-position, the resonance period TDRBCYCL is set to a resonance period TMDRBCYCL1 (e.g., 440 milliseconds) corresponding to the first-position, and an advance time period TDRBADV corresponding to the phase advance amount caused by the high-pass filtering is set to an advance time period TMDRBADV1 corresponding to the resonance frequency of the first-position (step S46).

If NGR is equal to "2", the gear ratio GEARRTO is set to a gear ratio GEARRTO2 of the second-position, the resonance period TDRBCYCL is set to a resonance period TMDRBCYCL2 (e.g., 330 milliseconds) corresponding to the second-position, and the advance time period TDRBADV is set to an advance time period TMDRBADV2 corresponding to the resonance frequency of the second-position (step S47).

If NGR is equal to "3", the gear ratio GEARRTO is set to a gear ratio GEARRTO3 of the third-position, the resonance period TDRBCYCL is set to a resonance period TMDRBCYCL3 (e.g., 300 milliseconds) corresponding to the third-position, and the advance time period TDRBADV is set to an advance time period TMDRBADV3 corresponding to the resonance frequency of the third-position (step S48).

If NGR is equal to "4", the gear ratio GEARRTO is set to a gear ratio GEARRTO4 of the fourth-position, the resonance period TDRBCYCL is set to a resonance period TMDRBCYCL4 (e.g., 280 milliseconds) corresponding to the fourth-position, and the advance time period TDRBADV is set to an advance time period TMDRBADV4 corresponding to the resonance frequency of the fourth-position (step S49).

If NGR is equal to "5", the gear ratio GEARRTO is set to a gear ratio GEARRTO5 of the fifth-position, the resonance period TDRBCYCL is set to a resonance period TMDRBCYCL5 (e.g., 260 milliseconds) corresponding to the fifth-position, and the advance time period TMDRBADV is set to an advance time period TMDRBADV5 corresponding to the resonance frequency of the fifth-position (step S50).

If NGR is equal to "6", the gear ratio GEARRTO is set to a gear ratio GEARRTO6 of the sixth-position, the resonance period TDRBCYCL is set to a resonance period TMDRBCYCL6 (e.g., 240 milliseconds) corresponding to the sixth-position, and the advance time period TDRBADV is set to a advance time period TMDRBADV6 corresponding to the resonance frequency of the sixth-position (step S51).

It is to be noted that the following relationships are satisfied with respect to the above-described parameters:

GEARRTO1>GEARRTO2>GEARRTO3>GEARRTO4>GEARRTO5>GEARRTO6

TMDRBCYCL1>TMDRBCYCL2>TMDRBCYCL3>TMDRBCYCL4>TMDRBCYCL5>TMDRBCYCL6

TMDRBADV1>TMDRBADV2>TMDRBADV3>TMDRBADV4>TMDRBADV5>TMDRBADV6

Referring back to FIG. 8, in step S35, a delay time period TDRBDLY is calculated as a time period required for the crankshaft to rotate 270 degrees, i.e., 1.5 TDC period by the following equation (8). The delay time period TDRBDLY corresponds to a sum of the detection delay (0.5 TDC period) of the engine rotational speed NE and the torque change delay (1 TDC period) described above. It is to be noted that the unit of NE10M[0] is [rpm].

$$TDRBLDY=45/NE10M[0] \quad (8)$$

In step S36, the delay time period TDRBDLY is subtracted from the advance time period TDRBADV calculated in step S34, to calculate a corrected time period TDRBDLYN. The corrected time period TDRBDLYN is modified to "0" if taking a negative value.

In step S37, a corrected discrete time m0 is calculated by the following equation (9).

$$m0=INT(TDRBDLYN/TCAL) \quad (9)$$

where TCAL is an execution period of this process, and INT(X) indicates an operation for rounding "X" to an integer near "X", e.g., by rounding off.

In step S38, the filtered engine rotational speed NEDRBN is set to the stored value NEDRB[m0] which is a value stored the corrected delay discrete time m0 before. By this setting, the timing correction of the filtered engine rotational speed NEDRBN is performed.

FIG. 10 is a flowchart of the TRQDRBTG calculation process executed in step S12 of FIG. 7.

In step S61, a preceding value TRQENGTGZ of a basic torque map value is set to a present value TRQENGTG. In step S62, it is determined whether or not the valve timing flag FVTSON is equal to "1".

If FVTSON is equal to "0", i.e., the low-speed valve timing is selected, the TRQTHL map is retrieved according to the basic opening command value THDRB and the engine rotational speed NE, to calculate the low-speed target torque TRQTHL (step S63). In step S64, the basic torque map value TRQENGTG is set to the low-speed target torque TRQTHL.

On the other hand, if FVTSON is equal to "1", i.e., the high-speed valve timing is selected, the TRQTHH map is retrieved according to the basic opening command value THDRB and the engine rotational speed NE, to calculate the high-speed target torque TRQTHH (step S65). In step S66, the basic torque map value TRQENGTG is set to the high-speed target torque TRQTHH.

In step S67, the basic torque change amount DTRQDRBTG is calculated by the following equation (10). The basic torque TRQDRBTG applied to the equation (10) is a preceding calculated value.

$$DTRQDRBTG=|TRQENGTG-TRQDRBTG| \quad (10)$$

In step S68, it is determined whether or not the basic torque map value TRQENGTG is greater than the basic torque TRQDRBTG (preceding value). If the answer to step S68 is affirmative (YES), i.e., the accelerator operation amount AP is increasing, it is determined whether or not the basic torque change amount DTRQDRBTG is greater than a predetermined increment threshold value DTRQDRBUP (step S69). If the answer to step S69 is affirmative (YES), i.e., an incremental amount of the demand torque is great, the basic torque TRQDRBTG is updated by the following equation (11) (step S71).

$$TRQDRBTG=TRQDRBTG+DTRQDRBUP \quad (11)$$

In step S69, if DTRQDRBTG is equal to or less than DTRQDRBUP, the basic torque TRQDRBTG is set to the basic torque map value TRQENGTG (step S72). The incremental amount of the basic torque TRQDRBTG is limited, by steps S69 and S71, to a value which is less than or equal to the predetermined increment threshold value DTRQDRBUP.

On the other hand, if the answer to step S68 negative (NO), i.e., the accelerator operation amount AP is decreasing, it is determined whether or not the basic torque change amount DTRQDRBTG is greater than a predetermined reduction threshold value DTRQDRBDWN (step S70). If the answer to step S70 is affirmative (YES), i.e., the reduction amount of the demand torque is great, the basic torque TRQDRBTG is updated by the following equation (12) (step S73).

$$TRQDRBTG=TRQDRBTG-DTRQDRBDWN \quad (12)$$

In step S70, if DTRQDRBTG is equal to or less than DTRQDRBDWN, the process proceeds to the above-described step S72. The reduction amount of the basic torque TRQDRBTG is limited, by steps S70 and S73, to a value which is less than or equal to the predetermined reduction threshold value DTRQDRBDWN.

The limit process with the predetermined increment threshold value DTRQDRBUP and the predetermined reduction threshold value DTRQDRBDWN is performed for preventing an extremely rapid change in the target torque and the threshold values DTRQDRBUP and DTRQDRBDWN are set so that the driver cannot perceive the delay of acceleration or deceleration.

FIG. 11 is a flowchart of the TRQDRBFF calculation process executed in step S13 of FIG. 7.

In step S81, the present value TRQENGTG and the preceding value TRQENGTGZ of the basic torque map value which are calculated in the process of FIG. 10 are applied to the following equation (13), to calculate a torque map value change amount DTRQENGTG.

$$DTRQENGTG=TRQENGTG-TRQENGTGZ \quad (13)$$

In step S82, it is determined whether or not a FF torque control execution flag FDRBCTRL is equal to "1". Normally, the answer to step S82 is negative (NO). Accordingly, the process proceeds to step S83, in which a torque change amount integrated value DTRQTGSUM is set to "0" and a value of an upcount timer CDRBCTRL is set to "0".

In step S84, it is determined whether or not the absolute value of the torque map value change amount DTRQENGTG calculated in step S81 is greater than an FF torque control execution threshold value DTRQDRBFF. If the answer to step S84 is negative (NO), the process immediately proceeds to step S86, in which the FF correction amount TRQDRBFF is set to "0".

In step S84, if |DTRQENGTG| is greater than DTRQDRBFF i.e., the change in the demand torque (accelerator operation amount AP) is great, the FF torque control execution flag FDRBCTRL is set to "1" (step S85). Thereafter, the process proceeds to step S86.

If the FF torque control execution flag FDRBCTRL is set to "1", the answer to step S82 becomes affirmative (YES), and the torque map value change amount DTRQENGTG is applied to the following equation (14) in step S87, to calculate the torque change amount integrated value DTRQTGSUM.

$$DTRQTGSUM=DTRQTGSUM+DTRQENGTG \quad (14)$$

In step S88, the calculation period TCAL is applied to the following equation (15), to update the value of the upcount timer CDRBCTRL.

$$CDRBCTRL=CDRBCTRL+TCAL \quad (15)$$

In step S89, it is determined whether or not the value of the timer CDRBCTRL is greater than the resonance period TDRBCYCL set in the process of FIG. 9. Since the answer to step S89 is initially negative (NO), the process proceeds to step S90, in which the value of the timer CDRBCTRL and the resonance period TDRBCYCL are applied to the following equation (16), to calculate an angle parameter FRQDRBCTRL.

$$FRQDRBCTRL=CDRBCTRL\times 360/TDRBCYCL \quad (16)$$

In step S91, a DRBSIN table shown in FIG. 12 is retrieved according to the angle parameter FRQDRBCTRL, to calculate a waveform coefficient DRBSIN. In this embodiment, the DRBSIN table is set so that the values corresponding to a cosine curve calculated by the following equation (17) are obtained.

$$DRBSIN=\cos(FRQDRBCTRL)-1 \quad (17)$$

The waveform coefficient DRBSIN, which changes in accordance with the waveform shown in FIG. 12, is generated by steps S90 and S91, wherein the angle parameter FRQDRBCTRL is set to "0" when the FF torque control starts.

In step S92, it is determined whether or not the torque change amount integrated value DTRQTGSUM is greater than "0". If DTRQTGSUM is greater than "0", a FF gain coefficient DRBFFTRQ is set to a first coefficient value DRBFFTRQUP (step S93), and if DTRQTGSUM is equal to or less than "0", the FF gain coefficient DRBFFTRQ is set to a second coefficient value DRBFFTRQDWN which is less than the first coefficient value DRBFFTRQUP (step S94). When the accelerator operation amount AP (demand torque) is decreasing, it is preferable to set the control gain to a less value than a value corresponding to the transient state where the demand torque is increasing, since it is necessary to prevent the engine rotational speed from increasing. By changing the FF gain coefficient DRBFFTRQ, in steps S92-S94, according to whether the accelerator operation amount AP is increasing or decreasing, the correction can be performed suitably in each transient state.

In step S95, the waveform coefficient DRBSIN, the FF gain coefficient DRBFFTRQ, and the torque change amount integrated value DTRQTGSUM are applied to the following equation (18), to calculate the FF correction amount TRQDRBFF.

$$TRQDRBFF=DRBSIN\times DTRQTGSUM\times DRBFFTRQ \quad (18)$$

Thereafter, if the value of the timer CDRBCTRL becomes equal to or greater than the resonance period TDRBCYCL, the process proceeds from step S89 to step S96, in which the FF torque control execution flag FDRBCTRL is set to "0" and the FF correction amount TRQDRBFF is set to "0".

According to the process of FIG. 11, when the accelerator pedal is depressed, for example, the FF correction amount TRQDRBFF is generated as follows: the FF correction amount TRQDRBFF decreases from the time the FF torque control starts during the first half of the period and increases during the second half of the period, in accordance with the waveform shown in FIG. 12. In contrast, when the accelerator pedal is returned from the depressed state, the torque change amount integrated value DTRQTGSUM takes a negative value. Consequently, the FF correction amount TRQDRBFF is generated as follows: the FF correction amount TRQDRBFF increases from the time the FF torque control starts during the first half of the period and decreases during the second half of the period, in accordance with the waveform which is obtained by inverting the waveform shown in FIG. 12. By generating the FF correction amount TRQDRBFF which changes with the waveform as shown in FIG. 12, the vibration caused by a rapid change in the demand torque (accelerator operation amount AP) can be effectively suppressed.

In step S17 of FIG. 7, the FF correction amount TRQDRBFF is added to the basic torque TRQDRBTG, to calculate the target torque TRQDRBN. The throttle valve opening TH is controlled according to the target torque TRQDRBN. Therefore, the throttle valve opening TH is controlled so that the output torque of the engine 1 coincides with the target torque TRQDRBN, thereby suppressing the vibration of the powertrain when the accelerator operation amount AP rapidly changes.

FIG. 13 is a flowchart of a process for calculating the ignition timing IGLOG. This process is executed by the CPU in the ECU 5 in synchronism with generation of the TDC pulse. The ignition timing IGLOG is defined by an advance amount of the ignition timing from a timing at which the piston is positioned at the compression top dead center.

In step S101, a basic ignition timing map is retrieved according to the engine rotational speed NE and the intake air flow rate GAIR, to calculate a basic ignition timing IGMAP. In step S102, the IGDRB calculation process shown in FIG. 14 is executed, to calculate the feedback correction amount IGDRB of the ignition timing IGLOG.

In step S103, the ignition timing IGLOG is calculated by the following equation (21).

$$IGLOG=IGMAP+IGDRB \quad (21)$$

FIG. 14 is a flowchart of the IGDRB calculation process executed in step S102 of FIG. 13.

In step S111, it is determined whether or not the vehicle speed VP is greater than "0". If the answer to step S111 is affirmative (YES), it is determined whether or not a fuel cut flag FFC is equal to "1" (step S112). The fuel cut flag FFC is set to "1" when the fuel cut operation, in which the fuel supply to the engine 1 is interrupted, is performed.

If the answer to step S112 is negative (NO), it is determined whether or not an engine stop flag FMEOF is equal to "1". If the answer to step S111 is negative (NO), or if the answer to steps S112 or S113 is affirmative (YES), i.e., if the vehicle is stopped, the fuel cut operation is performed, or the engine is stopped, the feedback correction amount IGDRB is set to "0" (step S114). Thereafter, the process proceeds to step S117.

If the answer to step S113 is negative (NO), i.e., if the vehicle is running, the fuel cut operation is not performed, and the engine is operating, the filtered engine rotational speed NEDRBN and the gear ratio GEARRTO are applied to the following equation (22), to calculate a basic FB correction amount IGDRBTG (step S115).

[Eq. 2]

$$IGDRBTG = -\frac{GAINIGDRB \times NEDRBN}{GEARRTO^2 \times GAIRCYL} \quad (22)$$

In the equation (22), GAINIGDRB is a feedback gain coefficient, and GAIRCYL is a cylinder intake air flow rate obtained by converting the detected intake air flow rate GAIR [g/sec] to the intake air flow rate per one TDC period [g/TDC] according to the engine rotational speed NE.

The following expression (22a), which is a portion of the equation (22) obtained by deleting the cylinder intake air flow rate GAIRCYL from the right side of the equation (22), corresponds to an expression obtained by multiplying the control gain by the right side of the equation (6). Since the square of the resonance frequency ω0 is inversely proportional to the square of the gear ratio GEARRTO, the square of the gear ratio GEARRTO is included in the expression (22a).

$$-GAINIGDRB \times NEDRBN/GEARRTO^2 \quad (22a)$$

Further, the cylinder intake air flow rate GAIRCYL is included in the equation (22) because the torque change amount caused by the correction of the ignition timing becomes greater as the cylinder intake air flow rate GAIRCYL becomes greater. By reducing the control gain as the cylinder intake air flow rate GAIRCYL increases, the correction can be performed accurately without being influenced by the engine load.

In step S116, an advancing direction limit value IGDRBADLMT and a retarding direction limit value IGDRBRTLMT are calculated by the following equations (23) and (24).

$$IGDRBADLMT = IGMAP - IGLOG + IGDRB \quad (23)$$

$$IGDRBRTLMT = IGLGG - IGLOG + IGDRB \quad (24)$$

where IGMAP, IGLOG, and IGDRB are respectively the preceding values of the basic ignition timing, the ignition timing, and the FB correction amount; and IGLGG is a retard limit value. If the ignition timing is retarded beyond the retard limit value IGLGG, the possibility that a misfire may occur becomes greater.

That is, the advancing direction limit value IGDRBADLMT of the FB correction amount IGDRB is set so that the ignition timing IGLOG is not advanced beyond the basic ignition timing IGMAP, and the retarding direction limit value IGDRBRTLMT is set so that the ignition timing IGLOG is not retarded beyond the retard limit value IGLGG.

In steps S117 to S121, the limit process with the limit values IGDRBADLMT and IGDRBRTLMT calculated in step S116 is executed. That is, if the basic FB correction amount IGDRBTG calculated in step S115 is greater than the advancing direction limit value IGDRGADLMT, the FB correction amount IGDRB is set to the advancing direction limit value IGDRGADLMT (step S117, S118). If the basic FB correction amount IGDRBTG is less than the retarding direction limit value IGDRGRTLMT, the FB correction amount IGDRB is set to the retarding direction limit value IGDRGRTLMT (step S119, S120). If the basic FB correction amount IGDRBTG is between the retarding direction limit value IGDRBRTLMT and the advancing direction limit value IGDRBADLMT, the FB correction amount IGDRB is set to the basic FB correction amount IGDRBTG (step S121).

In step S122, it is determined whether or not the absolute value of the filtered engine rotational speed NEDRBN is greater than a predetermined rotational speed threshold value NEDRBFC (e.g., 200 rpm). If the answer to step S122 is affirmative (YES), a downcount timer TNEDRBFC is set to a predetermined time period TMNEDRBFC (e.g., one second) and started (step S123). Thereafter, the process proceeds to step S124. If |NEDRBN| is equal to or less than NEDRBFC in step S122, the process immediately proceeds to step S124.

In step S124, it is determined whether or not the value of the timer TNEDRBFC started in step S123 is equal to "0". If the answer to step S124 is affirmative (YES), it is determined whether or not the value of the FB correction amount IGDRB is greater than "0" (step S125). If the answer to step S124 is negative (NO) or the answer to step S125 is affirmative (YES), i.e., immediately after the absolute value of the filtered engine rotational speed NEDRBN exceeds the predetermined rotational speed threshold value NEDRBFC, or when the FB correction amount IGDRB takes a positive value indicating that the ignition timing is corrected in the advancing direction, a fuel cut inhibition flag FIGDRBFC is set to "1" (step S127). If the fuel cut inhibition flag FIGDRBFC is set to "1", the fuel cut operation is inhibited.

It is necessary to correct the output torque in the increasing direction when the FB correction amount IGDRB is set to a value which corrects the ignition timing in the advancing direction. Therefore, by inhibiting the fuel cut operation, the vibration of the vehicle powertrain is prevented from further increasing due to the fuel cut operation.

If the answer to step S125 is a negative (NO), i.e., if the absolute value of the filtered engine rotational speed NEDRBN is equal to or less than the predetermined rotational speed threshold value NEDRBFC; a predetermined time period TMNEDRBFC has elapsed from the time of transition from the state where |NEDRBN| is greater than NEDRBFC to the state where |NEDRBN| is equal to or less than NEDRBFC; and the FB correction amount IGDRB is set to a value which is equal to or less than "0", the fuel cut inhibition flag FIGDRBFC is set to "0" (step S126).

According to the process of FIGS. 13 and 14, the FB correction amount IGDRB is calculated so that the filtered engine rotational speed NEDRBN converges to "0", and the ignition timing IGLOG is calculated by correcting the basic ignition timing IGMAP with the FB correction amount IGDRB. The filtered engine rotational speed NEDRBN is used as a parameter indicative of changes in the engine output torque. Therefore, the detection delay of the parameter indicative of changes in the engine output torque is greatly improved compared with the conventional method of using the parameter corresponding to the second-order derivative value calculated by the subtracting calculation, which makes it possible to obtain a good effect of suppressing the vibration.

In this embodiment, the accelerator sensor 31 and the ECU 5 constitute the torque change detecting means, and the crank angle position sensor 11 and the ECU 5 constitute the rotational speed detecting means. Further, the ECU 5 constitutes the feedforward correction amount generating means, the feedforward torque correcting means, the high-pass filtering means, the feedback torque correcting means, the timing correcting means, and the inhibiting means. Specifically, the process of FIGS. 9 and 11 correspond to the feedforward correction amount generating means, steps S17 to S22 of FIG. 7 correspond to the feedforward torque correcting means, steps S31 to S33 of FIG. 8 correspond to the high-pass filtering means, step S103 of FIG. 13 and the process of FIG. 14 correspond to the feedback torque correcting means, steps S31 and S34 to S38 of FIG. 8 correspond to the timing correcting means, and steps S125 and S127 of FIG. 14 correspond to the inhibiting means.

The present invention is not limited to the embodiment described above, and various modifications may be made. For example, the DRBSIN table used for calculating the FF correction amount TRQDRBFF is not limited to the table corresponding to the sinusoidal waveform shown in FIG. 12. Alternatively, a waveform shown in FIG. 15(*a*) which consists of a polygonal line, a waveform shown in FIG. 15(*b*) which corresponds to a half period of the sine wave, or a waveform shown in FIG. 15(*c*) which consists of two straight lines, may be adopted. Further, the angle at which the waveform coefficient DRBSIN becomes minimum, may be shifted slightly from the angle of 180 degrees as shown by the dashed lines in FIG. 15.

Further, in the above-described embodiment, the correction period for generating the FF correction amount TRQDRBFF is made to coincide with the resonance period TDRBCYCL. However, it is not necessary to make the correction period completely coincide with the resonance period TDRBCYCL, i.e., the correction period may be set to a value which is slightly shorter or slightly longer than the resonance period TDRBCYCL. The effect of suppressing the vibration becomes insufficient if the correction period is too short, while the vibration is emphasized if the correction period is too long. Therefore, the correction period can be set to a value of the range which does not cause such problems and is in the vicinity of the resonance period TDRBCYCL. According to the result of a simulation, the effect of suppressing the vibration is obtained even if the calculated resonance period TDRBCYCL shifts by a period corresponding to about ±0.2 Hz. When the resonance frequency takes the lowest value (the resonance period takes the longest value), i.e., when the shift position is set to the first-position, the resonance frequency is about 2.3 Hz. Therefore, the acceptable range of variation is about ±10%.

Further, in the above-described embodiment, the throttle valve opening command value THDRBG is used as the output torque control amount in the FF torque control, and the ignition timing IGLOG is used as the output torque control amount in the FB torque control. However, the output torque control amount is not limited to these parameters (THDRBG, IGLOG). For example, with respect to an engine wherein a lift amount LFT of the intake valve is continuously variable, the engine output torque control is performed mainly by changing the lift amount LFT. Therefore, it is preferable to use the lift amount LFT as the output torque control amount, instead of the throttle valve opening TH. Further, with respect to a diesel engine wherein the compression ignition is performed, the engine output torque control is performed mainly by changing a fuel injection amount QINJ. Therefore, it is preferable to use the fuel injection amount QINJ as the output torque control amount. In this case, the fuel injection amount QINJ is used as the output torque control amount for both of the FF torque control and the FB torque control.

INDUSTRIAL APPLICABILITY

The present invention can be applied, as described above, to a control system for a diesel internal combustion engine in addition to the gasoline internal combustion engine. Further, the present invention can be applied also to a watercraft propulsion engine such as an outboard engine having a vertically extending crankshaft.

The invention claimed is:

1. A control system for an internal combustion engine for driving a vehicle, which controls an output torque of said engine, said control system comprising:

torque change detecting means for detecting a rapid change in a demand torque of said engine;

feedforward correction amount generating means for generating a feedforward correction amount during a correction period which is substantially equal to a resonance period of a powertrain of said vehicle, from a time when the rapid change in the demand torque is detected; and feedforward torque correcting means for correcting an output torque control amount of said engine with the feedforward correction amount.

2. The control system according to claim 1, wherein said feedforward correction amount generating means generates the feedforward correction amount so that the output torque control amount is corrected in a direction opposite to a direction of the change in the demand torque from a time when the rapid change in the demand torque is detected, to a half-period elapsed time when a time period which is substantially equal to a half of the resonance period has elapsed, and the output torque control amount is corrected in a direction equal to the direction of the change in the demand torque after the half-period elapsed time.

3. The control system according to claim 1, wherein said feedforward correction amount generating means calculates a torque change amount integrated value by integrating an amount of change in the demand torque, and generates the feedforward correction amount according to the torque change amount integrated value.

4. The control system according to claim 1, wherein said feedforward correction amount generating means calculates the feedforward correction amount according to a direction of change in the demand torque.

5. A control system for an internal combustion engine for driving a vehicle, which controls an output torque of said engine, said control system comprising:

rotational speed detecting means for detecting a rotational speed of said engine;

high-pass filtering means for performing a high-pass filtering of the detected engine rotational speed, wherein a cutoff frequency of the high-pass filtering is set to a frequency lower than a resonance frequency of a powertrain of the vehicle; and feedback torque correcting means for correcting an output torque control amount of said engine in a feedback manner according to the high-pass filtered engine rotational speed.

6. The control system according to claim 5, wherein said feedback torque correcting means corrects the output torque control amount so that the high-pass filtered engine rotational speed becomes "0".

7. The control system according to claim 5, further comprising timing correcting means for performing a timing correction of the high-pass filtered engine rotational speed, wherein said feedback torque correcting means corrects the output torque control amount according to the engine rotational speed corrected by said timing correcting means.

8. The control system according to claim 7, wherein said timing correcting means performs the timing correction according to a phase advance caused by the high-pass filtering, a detection delay of said rotational speed detecting means, and a torque change delay which corresponds to a time period from a change in the output torque control amount to a change in the output torque of said engine caused by the change in the output torque control amount.

9. The control system according to claim 8, wherein said timing correcting means calculates an advance time period corresponding to the phase advance caused by the high-pass filtering, according to a gear ratio of a transmission connected to an output shaft of said engine, and performs the timing correction using the calculated advance time period.

10. The control system according to claim 5, wherein said feedback torque correcting means sets a gain of the feedback correction according to a gear ratio of a transmission connected to an output shaft of said engine and an intake air flow rate of said engine.

11. The control system according to claim 5, further comprising inhibiting means for inhibiting a fuel cut operation in which a fuel supply to said engine is stopped, when the feedback torque correcting means corrects the output torque control amount in a direction of increasing the output torque.

12. The control system according to claim 5, further comprising torque change detecting means for detecting a rapid change in a demand torque of said engine:

feedforward correction amount generating means for generating a feedforward correction amount during a correction period which is substantially equal to a resonance period of a powertrain of said vehicle from a time when the rapid change in the demand torque is detected; and feedforward torque correcting means for correcting the output torque control amount with the feedforward correction amount.

13. A control system for an internal combustion engine for driving a vehicle, which controls an output torque of said engine, said control system comprising:

torque change detecting means for detecting a rapid change in a demand torque of said engine;

feedforward correction amount generating means for generating a feedforward correction amount during a correction period which is substantially equal to a resonance period of a powertrain of said vehicle from a time when the rapid change in the demand torque is detected;

feedforward torque correcting means for correcting a first output torque control amount of said engine with the feedforward correction amount;

rotational speed detecting means for detecting a rotational speed of said engine;

high-pass filtering means for performing a high-pass filtering of the detected engine rotational speed; and feedback torque correcting means for correcting a second output torque control amount of said engine in a feedback manner according to the high-pass filtered engine rotational speed.

14. A control method for an internal combustion engine for driving a vehicle, which controls an output torque of said engine, said control method comprising the steps of:

a) detecting a rapid change in a demand torque of said engine;

b) generating a feedforward correction amount during a correction period which is substantially equal to a resonance period of a powertrain of said vehicle, from a time when the rapid change in the demand torque is detected; and c) correcting an output torque control amount of said engine with the feedforward correction amount.

15. The control method according to claim 14, wherein the feedforward correction amount is generated so that the output torque control amount is corrected in a direction opposite to a direction of the change in the demand torque from a time when the rapid change in the demand torque is detected, to a half-period elapsed time when a time period which is substantially equal to a half of the resonance period has elapsed, and the output torque control amount is corrected in a direction equal to the direction of the change in the demand torque after the half-period elapsed time.

16. The control method according to claim 14, wherein a torque change amount integrated value is calculated by integrating an amount of change in the demand torque, and the feedforward correction amount is generated according to the torque change amount integrated value.

17. The control method according to claim 14, wherein the feedforward correction amount is calculated according to a direction of change in the demand torque.

18. A control method for an internal combustion engine for driving a vehicle, which controls an output torque of said engine, said control method comprising the steps of:

a) detecting a rotational speed of said engine;

b) performing a high-pass filtering of the detected engine rotational speed, wherein a cutoff frequency of the high-pass filtering is set to a frequency lower than a resonance frequency of a powertrain of the vehicle; and c) correcting an output torque control amount of said engine in a feedback manner according to the high-pass filtered engine rotational speed.

19. The control method according to claim 18, wherein the output torque control amount is corrected so that the high-pass filtered engine rotational speed becomes "0".

20. The control method according to claim 18, further comprising the step of d) performing a timing correction of the high-pass filtered engine rotational speed, wherein the output torque control amount is corrected according to the timing-corrected engine rotational speed.

21. The control method according to claim 20, wherein the timing correction is performed according to a phase advance caused by the high-pass filtering, a detection delay in the detection of the engine rotational speed, and a torque change delay which corresponds to a time period from a change in the output torque control amount to a change in the output torque of said engine caused by the change in the output torque control amount.

22. The control method according to claim 21, wherein an advance time period corresponding to the phase advance caused by the high-pass filtering, is calculated according to a gear ratio of a transmission connected to an output shaft of said engine, and the timing correction is performed using the calculated advance time period.

23. The control method according to claim 18, wherein a gain of the feedback correction is set according to a gear ratio of a transmission connected to an output shaft of said engine and an intake air flow rate of said engine.

24. The control method according to claim 18, further comprising the step of e) inhibiting a fuel cut operation in which a fuel supply to said engine is stopped, when the output torque control amount is corrected in a direction of increasing the output torque.

25. The control method according to claim 18, further comprising the steps of f) detecting a rapid change in a demand torque of said engine:

g) generating a feedforward correction amount during a correction period which is substantially equal to a resonance period of a powertrain of said vehicle from a time when the rapid change in the demand torque is detected; and h) correcting the output torque control amount with the feedforward correction amount.

26. A control method for an internal combustion engine for driving a vehicle, which controls an output torque of said engine, said control method comprising the steps of:

a) detecting a rapid change in a demand torque of said engine;

b) generating a feedforward correction amount during a correction period which is substantially equal to a resonance period of a powertrain of said vehicle from a time when the rapid change in the demand torque is detected;

c) correcting a first output torque control amount of said engine with the feedforward correction amount;

d) detecting a rotational speed of said engine;

e) performing a high-pass filtering of the detected engine rotational speed; and f) correcting a second output torque control amount of said engine in a feedback manner according to the high-pass filtered engine rotational speed.

* * * * *